US008967102B2

(12) United States Patent
Kobayashi et al.

(10) Patent No.: US 8,967,102 B2
(45) Date of Patent: Mar. 3, 2015

(54) VALVE TIMING CONTROL DEVICE

(71) Applicant: Aisin Seiki Kabushiki Kaisha, Kariya (JP)

(72) Inventors: Masaki Kobayashi, Okazaki (JP); Kenji Nonaka, Nagoya (JP); Shohei Masuda, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/946,073

(22) Filed: Jul. 19, 2013

(65) Prior Publication Data

US 2014/0033999 A1 Feb. 6, 2014

(30) Foreign Application Priority Data

Aug. 1, 2012 (JP) ..... 2012-171013

(51) Int. Cl.

*F01L 1/34* (2006.01)
*F01L 1/344* (2006.01)
*F01L 1/26* (2006.01)

(52) U.S. Cl.

CPC . *F01L 1/344* (2013.01); *F01L 1/26* (2013.01); *F01L 1/3442* (2013.01); *F01L 2001/34453* (2013.01); *F01L 2001/34459* (2013.01); *F01L 2001/34463* (2013.01); *F01L 2001/34466* (2013.01); *F01L 2001/34476* (2013.01); *F01L 2800/00* (2013.01)

USPC ..... 123/90.15; 123/90.17; 464/160

(58) Field of Classification Search

USPC ..... 123/90.15, 90.17; 464/160

See application file for complete search history.

(56) References Cited

U.S. PATENT DOCUMENTS

| | | | | |
|---|---|---|---|---|
| 6,976,460 | B2 | 12/2005 | Komazawa et al. | |
| 8,522,737 | B2 * | 9/2013 | Yokoyama et al. | 123/90.17 |
| 2011/0315104 | A1 | 12/2011 | Imamura et al. | |

FOREIGN PATENT DOCUMENTS

| | | | |
|---|---|---|---|
| EP | 1452700 | A1 | 9/2004 |
| EP | 1672188 | A1 | 6/2006 |
| EP | 2418360 | A1 | 2/2012 |
| JP | 2010-223170 | A | 10/2010 |
| JP | 2012-013051 | A | 1/2012 |
| JP | 2012-092722 | A | 5/2012 |
| WO | WO 2010116532 | A1 * | 10/2010 |

OTHER PUBLICATIONS

Extended European Search Report dated Dec. 20, 2013, issued by Eurpoean Patent Office in corresponding European Application No. 13178748.3 (6 pgs).

* cited by examiner

*Primary Examiner* — Ching Chang
(74) *Attorney, Agent, or Firm* — Buchanan Ingersoll & Rooney PC

(57) ABSTRACT

Provided is a valve timing control device, including a drive side rotating member, a driven side rotating member, and a locking mechanism, in which the locking mechanism includes a regulating body, and n stepped portions with which the regulating body engages, the relative rotation phase is regulated in steps from a most retarded phase or most advanced phase until reaching the lock phase, and the positional relationship between the stepped portions and regulating body is set so that, among relative rotations of from a first relative rotation of from the most retarded phase or most advanced phase to a first relative rotation phase regulated by a first stepped portion to a last relative rotation to a last relative rotation, a first predetermined relative rotation other than the last relative rotation is the smallest.

17 Claims, 16 Drawing Sheets

START OF LOCKING OPERATION
(RELATIVE ROTATION PHASE: 0 DEGREES (MOST RETARDED PHASE))

ENGAGED WITH FIRST STEPPED PORTION (RELATIVE ROTATION PHASE: 4 DEGREES)

ENGAGED WITH SECOND STEPPED PORTION
(RELATIVE ROTATION PHASE: 12 DEGREES)

ENGAGED WITH THIRD STEPPED PORTION (RELATIVE ROTATION PHASE: 20 DEGREES)

ENGAGED WITH LAST STEPPED PORTION
(RELATIVE ROTATION PHASE: 28 DEGREES (LOCK PHASE))

VALVE TIMING CONTROL DEVICE

CROSS REFERENCE TO RELATED APPLICATIONS

This application is based on and claims priority under 35 U.S.C. §119 to Japanese Patent Application 2012-171013 filed on Aug. 1, 2012, the entire content of which is incorporated herein by reference.

TECHNICAL FIELD

This disclosure relates to a valve timing control device.

BACKGROUND DISCUSSION

To date, there has been known a valve timing control device including a drive side rotating member that rotates in synchronization with a crankshaft and a driven side rotating member, disposed so as to be rotatable relative to the drive side rotating member, that rotates together with a camshaft (for example, refer to JP 2012-92722A (Reference 1)).

JP 2012-92722A (Reference 1) discloses a hydraulically-driven variable valve device (valve timing control device) including a housing (drive side rotating member) that rotates in synchronization with a crankshaft, a vane rotor (driven side rotating member), disposed so as to be rotatable relative to the housing, that rotates together with a camshaft, and a holding mechanism (locking mechanism) that locks the relative rotation phase of the housing and vane rotor at a phase (lock phase), positioned between a most retarded phase and a most advanced phase, appropriate to starting up an engine. The holding mechanism of the hydraulically-driven variable valve device is configured so as to, utilizing a flip-flop action of the vane rotor due to camshaft torque fluctuation (alternating torque), cause the relative rotation phase of the housing and vane rotor to reach a lock phase appropriate to starting up the engine from the most retarded phase, while regulating in steps by causing a pin (regulating body) to engage sequentially with a plurality of stepped portions, when starting up the engine. In Reference 1, of relative rotations θ1 to θ4 of a first step relative rotation (a first relative rotation from the most retarded phase to a first stepped portion) θ1 to a last step relative rotation (a last relative rotation from a penultimate stepped portion to a last stepped portion) θ4, the last step relative rotation θ4 is set to be the smallest.

However, as the hydraulically-driven variable valve device (valve timing control device) of Reference 1 is such that the last step relative rotation θ4 is set to be the smallest, the relative rotations θ1 to θ3 of the steps before the last step are relatively large in comparison with the last step relative rotation θ4, because of which, the amount of vane rotor flip-flop necessary in order to cause the pin to engage with the stepped portions corresponding to the steps before the last step increases commensurately.

Herein, the amount of vane rotor flip-flop due to the camshaft torque fluctuation has a tendency to be small immediately after cranking is started (in an initial cranking stage shortly after cranking is started), and to subsequently increase gradually. That is, when starting up the engine, hydraulic oil for regulating the relative rotation phase by hydraulic pressure when the engine is operating being loaded in a hydraulic chamber configured by the vane rotor and housing, the loaded hydraulic oil is gradually discharged, utilizing the camshaft torque fluctuation, when the engine is started up.

As the amount of vane rotor flip-flop gradually increases from the small condition immediately after cranking is started (the initial cranking stage), as heretofore described, it may happen that the amount of vane rotor flip-flop at a step (for example, the first step or second step) before the last step is not sufficiently large. In this case, when the amount of flip-flip necessary in order to cause the pin to engage with the stepped portion corresponding to a step before the last step is large, as in the hydraulically-driven variable valve device of Reference 1, time is needed for the pin to engage with the stepped portion corresponding to the step before the last step, because of which, time is needed to bring the relative rotation phase nearer to a lock phase appropriate to starting up the engine from the most retarded phase, as a result of which, there is a problem in that it is not possible to cause the relative rotation phase to swiftly reach a lock phase appropriate to starting up the engine.

A need thus exists for a valve timing control device which is not susceptible to the drawback mentioned above.

SUMMARY

In order to solve the above-described problem, according to one aspect of this disclosure, there is provided a valve timing control device, including:

a drive side rotating member that rotates in synchronization with an engine crankshaft;

a driven side rotating member, disposed so as to be rotatable relative to the drive side rotating member on the same axis as the drive side rotating member, that rotates together with a camshaft that opens and closes at least one of an inlet valve and exhaust valve of the engine; and a locking mechanism that locks the relative rotation phase of the drive side rotating member and driven side rotating member at a lock phase, wherein the locking mechanism includes a regulating body, and n (n is a positive integer) stepped portions with which the regulating body engages, allowing a relative rotation bringing the relative rotation phase nearer to the lock phase and regulating a relative rotation whereby the relative rotation phase is distanced from the lock phase, the relative rotation phase is regulated in steps from a most retarded phase or most advanced phase until reaching the lock phase by the regulating body engaging sequentially with a plurality of stepped portions, and the positional relationship between the stepped portions and regulating body is set so that, among relative rotations of from a first relative rotation of from the most retarded phase or most advanced phase to a first relative rotation phase regulated by a first stepped portion of the n stepped portions to a last relative rotation from an $n^{th}-1$ relative rotation phase regulated by an $n^{th}-1$ stepped portion of the n stepped portions to a last relative rotation to the lock phase regulated by an $n^{th}$ stepped portion, a first predetermined relative rotation other than the last relative rotation is the smallest.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Embodiments disclosed here will be explained with reference to the attached drawings.

Embodiment 1

Referring to FIGS. 1 to 10, a description will be given of a configuration of a valve timing control device 100 according to Embodiment 1 disclosed here.

Figure 1:
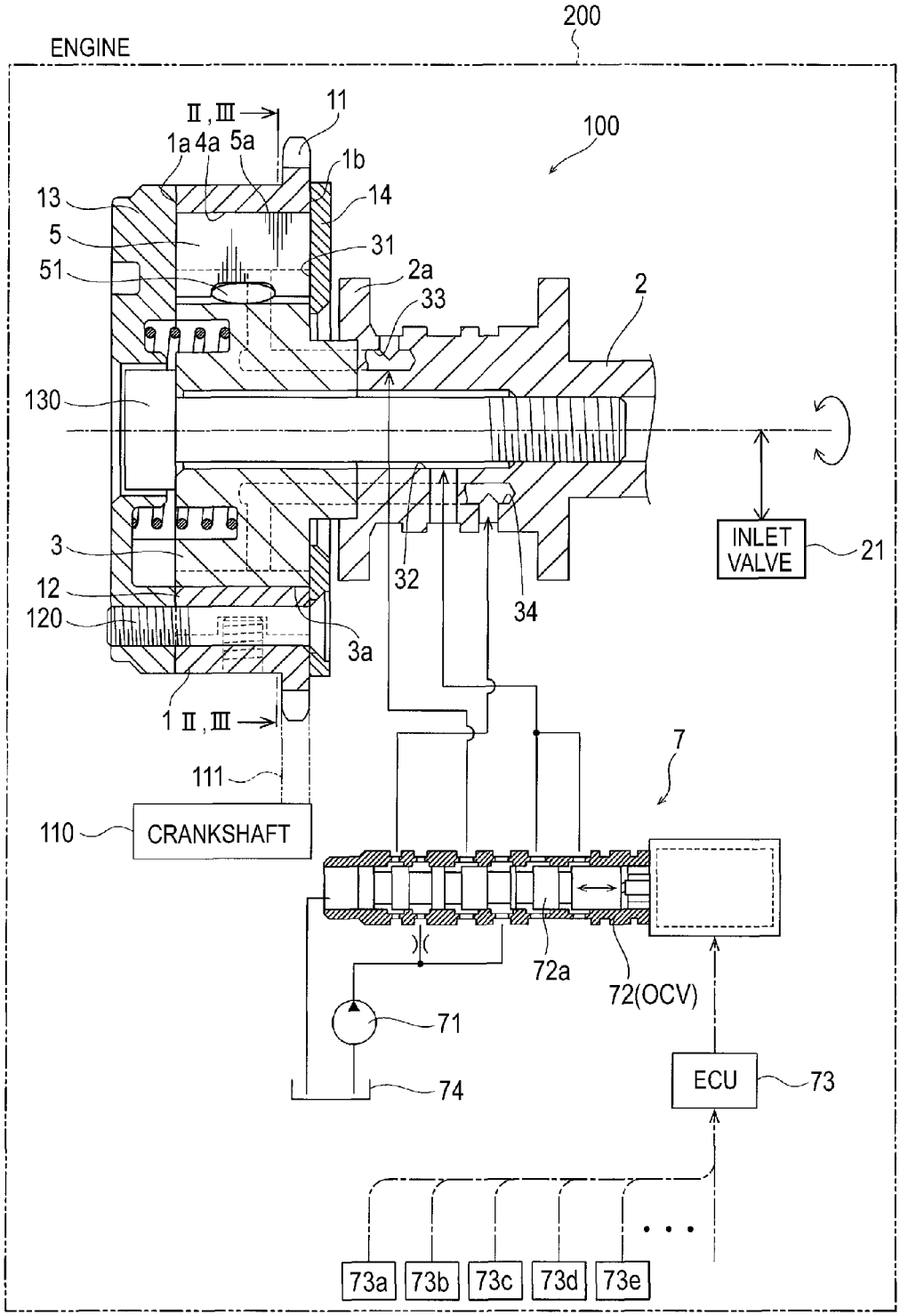
FIG. 1 is a schematic view showing an overall configuration of a valve timing control device according to Embodiment 1 disclosed here.
Figure 2:
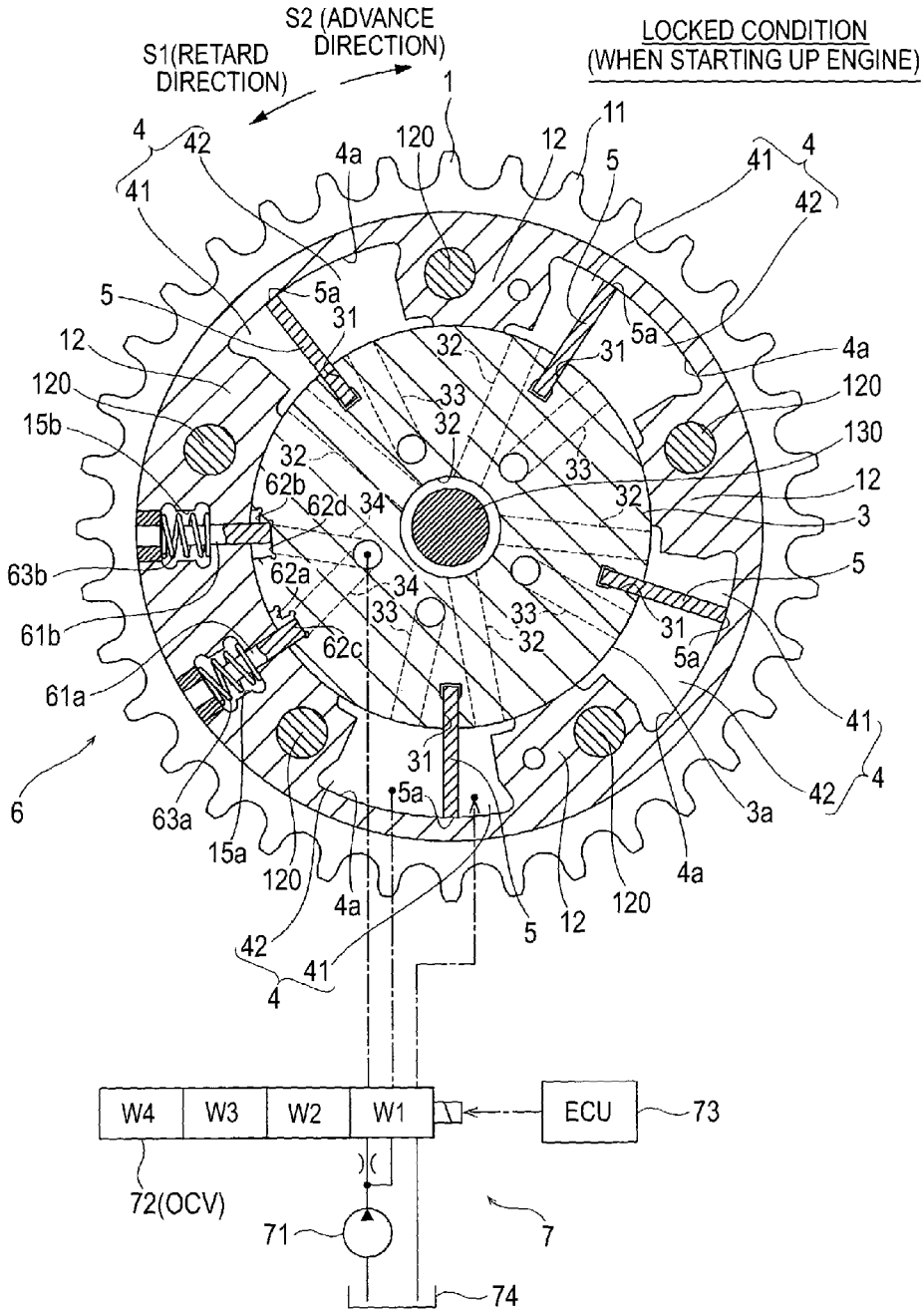
FIG. 2 is a diagram showing a condition of being locked at a lock phase when starting up an engine in a schematic sectional view along a II-II line of FIG. 1.
Figure 3:
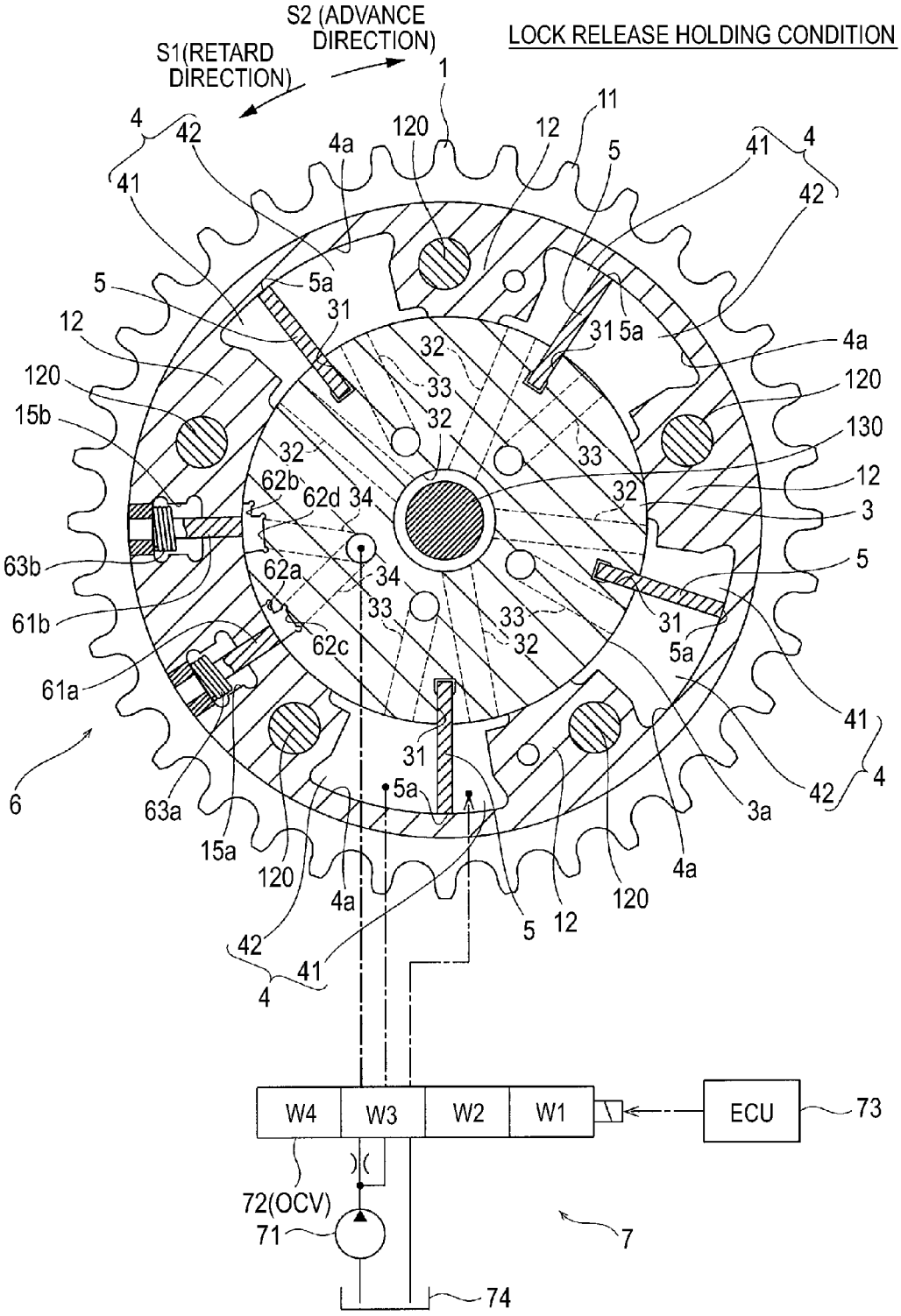
FIG. 3 is a diagram showing a condition of being held in a condition that the locking is released in a schematic sectional view along a III-III line of FIG. 1.

The valve timing control device 100 according to Embodiment 1 includes an external rotor 1, including a timing sprocket 11 formed integrally with an outer peripheral portion of the external rotor 1, a camshaft 2 (refer to FIG. 1) that opens and closes an inlet valve 21, and an internal rotor 3 that rotates integrally with the camshaft 2, as shown in FIGS. 1 to 3. The valve timing control device 100 is configured so as to be able to control the timing of the inlet valve 21 of an automobile engine 200. The external rotor 1 is one example of a "drive side rotating member" disclosed here, while the internal rotor 3 is one example of a "driven side rotating member" disclosed here.

The external rotor 1 is configured so as to rotate in synchronization with a crankshaft 110. Specifically, as shown in FIG. 1, a circular timing chain 111 is mounted in a condition that it has a predetermined tension on gears attached to the timing sprocket 11 and crankshaft 110. Because of this, on the crankshaft 110 rotationally driving when the engine is operating, the external rotor 1 is rotated in synchronization with the crankshaft 110 via the timing chain 111. Also, as shown in FIGS. 2 and 3, four protrusions 12 are integrally provided on the external rotor 1, protruding inward in a radial direction from the outer peripheral portion. The four protrusions 12 are disposed distanced from each other in a circumferential direction. Also, as shown in FIG. 1, a front plate 13 is provided on the front side (the side opposite the side on which the camshaft 2 is disposed) of the external rotor 1, while a rear plate 14 is provided on the rear side (the side on which the camshaft 2 is disposed) of the external rotor 1. The front plate 13 and rear plate 14 are fixedly attached with a plurality of bolts 120 to the external rotor 1 in a condition in which they are in contact with a front surface 1*a* and rear surface 1*b* respectively of the external rotor 1.

As shown in FIG. 1, the camshaft 2 is fixedly attached to the internal rotor 3 with a bolt 130 disposed on a rotation axis of the camshaft 2 in a leading end portion 2*a* of the camshaft 2. Because of this, the camshaft 2 is rotated integrally with the internal rotor 3. Also, the camshaft 2 is configured so as to, by rotating integrally with the internal rotor 3 in accompaniment to the rotation of the external rotor 1 when the engine is operating, press down the inlet valve 21 with a cam provided on the camshaft 2, thereby causing the valve to open.

As shown in FIGS. 1 to 3, the internal rotor 3 that rotates integrally with the camshaft 2 is disposed so as to be rotatable relative to the external rotor 1 on the same axis as the external rotor 1. Also, the internal rotor 3 is disposed on the inner side of the external rotor 1, and is configured so that an outer peripheral surface 3*a* slides against the four protrusions 12 of the external rotor 1. Also, as shown in FIGS. 2 and 3, hydraulic chambers 4 are formed in four regions enclosed by the four protrusions 12 of the external rotor 1 and the outer peripheral surface 3*a* of the internal rotor 3. Vane grooves 31 are formed in positions in the internal rotor 3 corresponding to each of the four hydraulic chambers 4. A vane 5 that divides the corresponding hydraulic chamber 4 in a circumferential direction into an advance chamber 41 and retard chamber 42 is inserted into each vane groove 31. Each of the four vanes 5 is provided so as to divide the corresponding hydraulic chamber 4 into the advance chamber 41 and retard chamber 42 by protruding to the outer side in a radial direction from the internal rotor 3. Also, as shown in FIG. 1, the vane 5 is biased toward the outer side in a radial direction by a biasing member 51 disposed in a bottom portion of the vane groove 31. Because of this, a leading end portion 5*a* of the vane 5 is pressed in a slidable condition against an inner peripheral surface 4*a* of the hydraulic chamber 4.

As shown in FIGS. 1 to 3, an advance passage 32 leading to the advance chamber 41, a retard passage 33 leading to the retard chamber 42, and lock oil passages 34 leading to stepped portions 62*a* to 62*d* of a locking mechanism 6, to be described hereafter, are formed in the camshaft 2 and internal rotor 3. The advance passage 32, retard passage 33, and lock oil passages 34 are each connected to a hydraulic circuit 7, to be described hereafter.

As shown in FIGS. 2 to 8, the locking mechanism 6, which locks (holds) the relative rotation phase of the external rotor 1 and internal rotor 3 (the relative rotation phase of the crankshaft 110 and camshaft 2) when starting up the engine 200 in a lock phase appropriate to starting up the engine (such that the engine can be started up smoothly) set between a most advanced phase and a most retarded phase, is provided in the valve timing control device 100. The locking mechanism 6 is configured so as to gradually shift the relative rotation phase of the external rotor 1 and internal rotor 3 from the most retarded phase to the lock phase when starting up the engine. Also, the locking mechanism 6 includes a pair of regulating bodies 61*a* and 61*b*, which allow a relative rotation bringing the relative rotation phase of the external rotor 1 and internal rotor 3 nearer to the lock phase and regulate a relative rotation whereby the relative rotation phase of the external rotor 1 and internal rotor 3 is distanced from the lock phase, and the four stepped portions 62*a* to 62*d*, with which the pair of regulating bodies 61*a* and 61*b* engage.

The pair of regulating bodies 61*a* and 61*b* are disposed with a predetermined distance therebetween in a circumferential direction. As shown in FIGS. 2 and 3, the pair of regulating bodies 61*a* and 61*b* are housed respectively in regulating body housing portions 15*a* and 15*b* provided in the protrusion 12 of the external rotor 1. Also, the pair of regulating bodies 61*a* and 61*b* are configured so as to be able to move linearly in a radial direction, so as to protrude from the protrusion 12 of the external rotor 1 to the internal rotor 3 side. Also, the pair of regulating bodies 61*a* and 61*b* are biased in a radial direction toward the inner side (the internal rotor 3 side) by springs 63*a* and 63*b* respectively.

As shown in FIGS. 2 to 8, the four stepped portions 62*a* to 62*d* are formed in cutaway form in the outer periphery of the internal rotor 3. Specifically, of the four stepped portions 62*a* to 62*d*, the first stepped portion 62*a* and third stepped portion 62*c* are provided in positions corresponding to the one regulating body 61*a*, while the second stepped portion 62*b* and last (fourth) stepped portion 62*d* are provided in positions corresponding to the other regulating body 61*b*. The first stepped portion 62*a* is disposed in a position recessed one step inward in a radial direction from the outer peripheral surface 3*a* of the internal rotor 3, while the third stepped portion 62*c* is disposed in a position recessed one step further inward in a radial direction than the stepped portion 62*a*. Also, the second stepped portion 62*b* is disposed in a position recessed one step inward in a radial direction from the outer peripheral surface 3*a* of the internal rotor 3, while the last stepped portion 62*d* is disposed in a position recessed one step further inward in a radial direction than the stepped portion 62*b*.

Herein, in Embodiment 1, the locking mechanism 6 has a function of gradually bringing the relative rotation phase of the external rotor 1 and internal rotor 3 (the relative rotation phase of the internal rotor 3 with respect to the external rotor 1) nearer to the lock phase from the most retarded phase, utilizing the fact that the internal rotor 3 flip-flops in a retard direction S1 and advance direction S2 due to torque fluctuation (alternating torque) of the camshaft 2 when starting up the engine 200, eventually holding the relative rotation phase of the external rotor 1 and internal rotor 3 in the lock phase. Specifically, the locking mechanism 6 is configured so as to cause the relative rotation phase of the external rotor 1 and internal rotor 3 to reach the lock phase in four steps by the pair of regulating bodies 61*a* and 61*b* sequentially engaging with the four stepped portions 62*a* to 62*d* (the first stepped portion 62*a*, second stepped portion 62*b*, third stepped portion 62*c*, and last stepped portion 62*d*). Details of a locking operation will be described hereafter.

Also, in Embodiment 1, the positional relationship between the pair of regulating bodies 61*a* and 61*b* and the four stepped portions 62*a* to 62*d* is set so that, of relative rotations from a first step relative rotation (a first relative rotation) from the most retarded phase to a relative rotation phase (a first relative rotation phase) regulated by the first stepped portion 62*a* to a last step (fourth step) relative rotation (a last relative rotation) from a relative rotation phase (a third relative rotation phase) regulated by the penultimate (third) stepped portion 62*c* to a relative rotation phase (lock phase) regulated by the last stepped portion 62*d*, the relative rotation of a step (the first step in Embodiment 1) other than the last step is the smallest. Specifically, as well as the relative rotation of the first step being the smallest, the relative rotations of the second step to last step are set to be equal to each other at twice the size of the relative rotation of the first step. The relative rotation of the first step (the first relative rotation) is one example of a "first predetermined relative rotation" disclosed here.

Figure 9:
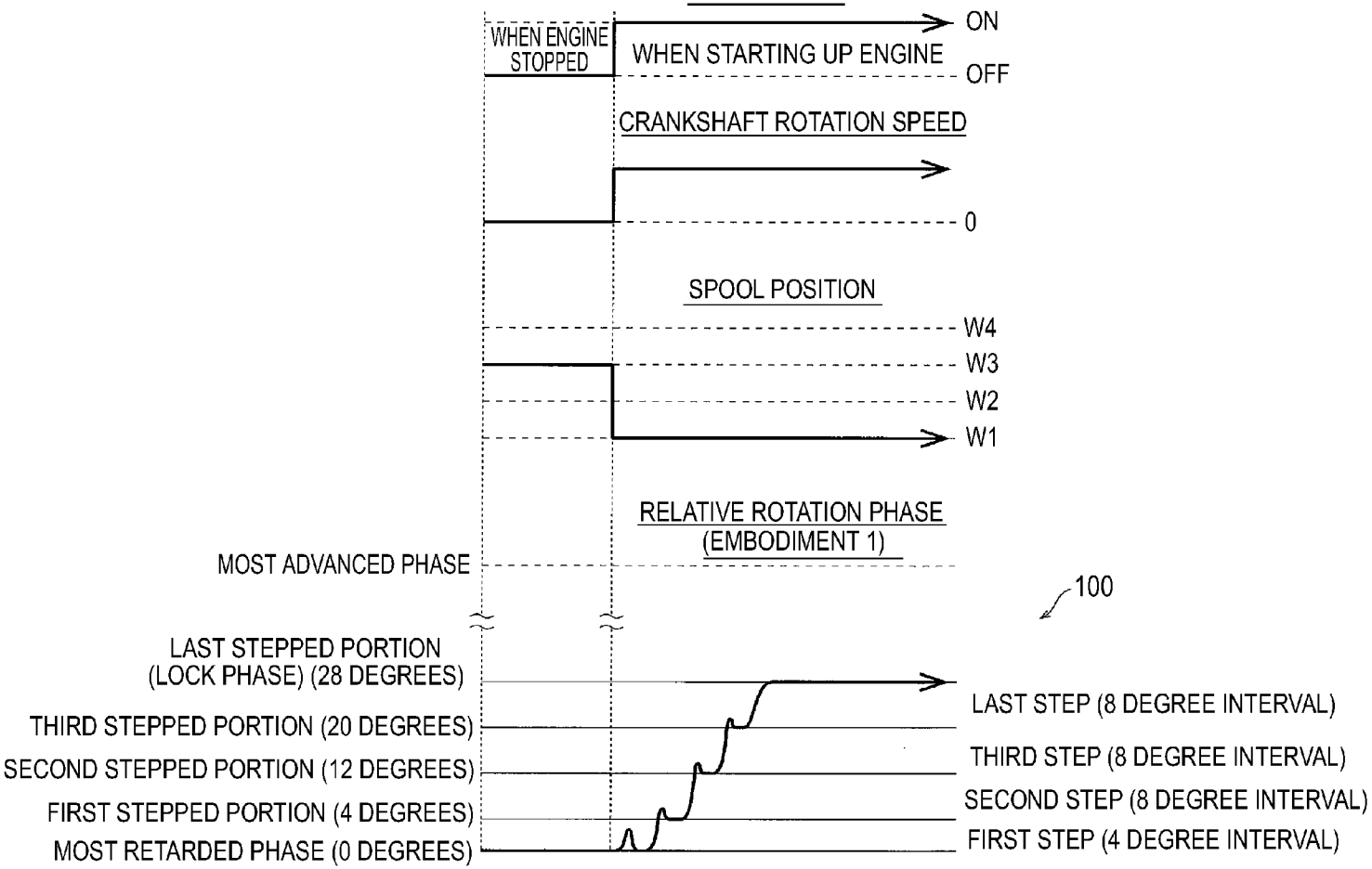
FIG. 9 is a timing chart showing a control condition of the valve timing control device according to Embodiment 1 of this disclosure when starting up the engine.

Specifically, in Embodiment 1, as shown in FIG. 9, the relative rotation of the first step is a relative angle (phase difference) of 4 degrees, while the relative rotation of each of the second step to last step is a relative angle of 8 degrees. That is, the relative rotation phase of the external rotor 1 and internal rotor 3 (the relative rotation phase of the internal rotor 3 with respect to the external rotor 1) is regulated by the first stepped portion 62*a* to a phase (the first relative rotation phase) a relative angle of 4 degrees in the advance direction S2, with the most retarded phase as a reference, and regulated by the second stepped portion 62*b* to a phase (a second relative rotation phase) a relative angle of 12 degrees in the advance direction S2. Also, the relative rotation phase of the external rotor 1 and internal rotor 3 (the relative rotation phase of the internal rotor 3 with respect to the external rotor 1) is regulated by the third stepped portion 62*c* to a phase (the third relative rotation phase) a relative angle of 20 degrees in the advance direction S2, with the most retarded phase as a reference, and regulated by the last stepped portion 62*d* and third stepped portion 62*c* to the lock phase a relative angle of 28 degrees in the advance direction S2. The heretofore mentioned relative angles are rotation angles (crank angles) having the rotation angle of the crankshaft 110 as a reference.

As shown in FIGS. 1 to 3, the valve timing control device 100 includes the hydraulic circuit 7 for supplying hydraulic oil, which is for regulating the relative rotation phase of the external rotor 1 and internal rotor 3 by hydraulic pressure, to the hydraulic chamber 4, or for discharging hydraulic oil from the hydraulic chamber 4, when the engine is operating. The hydraulic circuit 7 is provided in order to regulate the amount of hydraulic oil loaded into the advance chamber 41 and retard chamber 42 of the hydraulic chamber 4, thereby regulating the position of the vane 5 in the hydraulic chamber 4. Specifically, the hydraulic circuit 7 is configured so as to regulate the amount of hydraulic oil in the advance chamber 41 via the advance passage 32, and to regulate the amount of hydraulic oil in the retard chamber 42 via the retard passage 33. Because of this, the relative rotation phase of the external rotor 1 and internal rotor 3 is regulated when the engine is operating, and the timing of the inlet valve 21 of the engine 200 is changed.

Also, the hydraulic circuit 7 is configured so as to control a locking operation and lock releasing operation by the locking mechanism 6. Specifically, as shown in FIG. 1, the hydraulic circuit 7 includes an oil pump 71 that supplies hydraulic oil and lock oil for a locking operation by the locking mechanism 6, a solenoid type oil control valve (OCV) 72 having a spool 72*a*, an electronic control unit (ECU) 73 that controls the OCV 72, and an oil pan 74 in which the hydraulic oil and lock oil are stocked. The advance passage 32, retard passage 33, and lock oil passage 34 are each connected to a predetermined port among a plurality of ports provided in the OCV 72.

Figure 10:
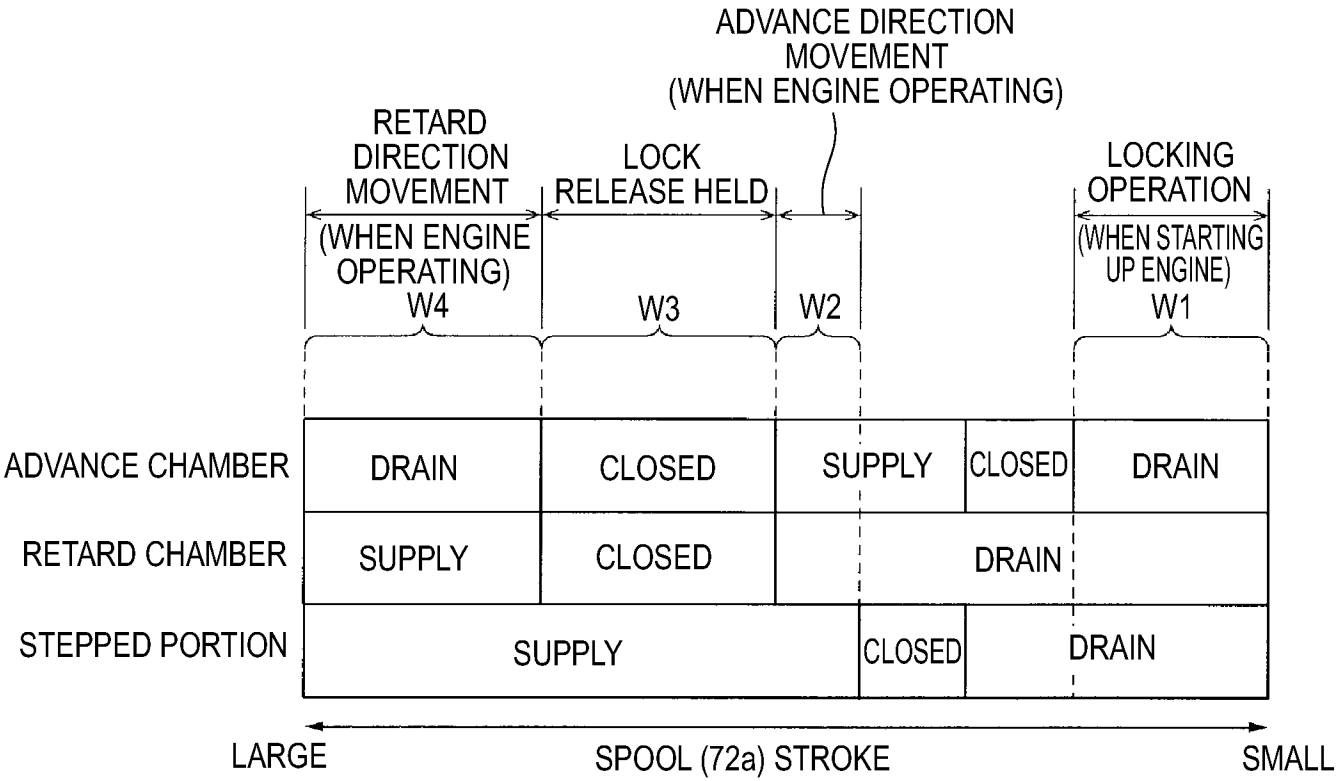
FIG. 10 is a diagram showing an operating configuration of an oil control valve (OCV) of the valve timing control device according to Embodiment 1 of this disclosure.

As shown in FIGS. 2, 3, and 10, the OCV 72 is configured so as to switch the position of the spool 72*a* (refer to FIG. 10) in four steps from a position W1 to a position W4 based on a control by the ECU 73. By so doing, the loading condition of hydraulic oil in the advance chamber 41 and retard chamber 42 and the loading condition of lock oil in the stepped portions 62*a* to 62*d* are regulated. Specifically, as shown in FIG. 10, in the event that the position of the spool 72*a* is switched to the position W1 (locking operation position) when the engine is started up, the regulating bodies 61*a* and 61*b* take on a condition that they can be inserted into the stepped portions 62*a* to 62*d* by the lock oil in the stepped portions 62*a* to 62*d* being discharged (drained) to the oil pan 74 side. That is, the regulating bodies 61*a* and 61*b* are inserted into the stepped portions 62*a* to 62*d* by the biasing force of the springs 63*a* and 63*b* respectively, bringing about a condition that a locking operation is possible. Also, the hydraulic oil loaded into the advance chamber 41 and retard chamber 42 is also discharged (drained) to the oil pan 74 side, whereby the hydraulic pressure of the hydraulic chamber 4 decreases.

In the event that the position of the spool 72*a* is switched to the position W2 (an advance direction movement position) when the engine is operating, the regulating bodies 61*a* and 61*b* are pushed back outward in a radial direction by the hydraulic pressure of the lock oil owing to the lock oil being supplied into the stepped portions 62*a* to 62*d*, and the locked condition of the relative rotation phase caused by the regulating bodies 61*a* and 61*b* is released. Further, by the hydraulic oil of the retard chamber 42 being discharged while hydraulic oil is supplied to the advance chamber 41 in the position W2, the relative rotation phase of the external rotor 1 and internal rotor 3 is moved in the advance direction S2.

In the event that the position of the spool 72*a* is switched to the position W3 (a lock release holding position) when the engine is operating or when the engine is stopped, the supply and discharge of hydraulic oil to and from the advance chamber 41 and retard chamber 42 is stopped by the lock oil being supplied into the stepped portions 62*a* to 62*d* in a condition that the locked condition of the relative rotation phase is released, as shown in FIG. 3. Because of this, the relative rotation phase of the external rotor 1 and internal rotor 3 is maintained in the current position, in a condition that the locked condition is released, when the engine is operating or when the engine is stopped.

Also, in the event that the position of the spool 72*a* is switched to the position W4 (a retard direction movement position) when the engine is operating, the relative rotation phase of the external rotor 1 and internal rotor 3 is moved in the retard direction S1 by the hydraulic oil of the advance chamber 41 being discharged while hydraulic oil is supplied to the retard chamber 42 in a condition that the locked condition of the relative rotation phase is released by the lock oil being supplied into the stepped portions 62*a* to 62*d*.

As shown in FIG. 1, the ECU 73 is configured of a cam angle sensor 73*a* that detects the phase of the camshaft 2, a crank angle sensor 73*b* that detects the phase of the crankshaft 110, a temperature sensor 73*c* that detects the temperature of the engine oil, a rotation speed sensor 73*d* that detects the rotation speed of the crankshaft 110 (the engine speed), and an ignition key switch (IG/SW) 73*e*, so that various kinds of detection signal can be obtained. Furthermore, the ECU 73 can also obtain detection signals from sensors (a car speed sensor, a water temperature sensor, and the like) other than those heretofore mentioned. Also, the ECU 73 can obtain the relative rotation phase of the external rotor 1 and internal rotor 3 (the relative rotation phase of the crankshaft 110 and camshaft 2) from the result of the camshaft 2 phase detection by the cam angle sensor 73*a* and the result of the crankshaft 110 phase detection by the crank angle sensor 73*b*. Further, the ECU 73 is configured so as to regulate (move) the relative rotation phase of the external rotor 1 and internal rotor 3 to a phase appropriate to the current operating condition by controlling the position of the spool 72*a* of the OCV 72 based on the detection signals obtained from the heretofore mentioned various kinds of sensor.

Next, referring to FIGS. 4 to 9, a description will be given of the locking operation when starting up the engine by the valve timing control device 100 according to Embodiment 1 disclosed here.

Firstly, as shown in FIG. 9, the ECU 73, on an ignition ON signal being input from the IG/SW 73*e*, carries out a control cranking the crankshaft 110 (an operation control that forcibly causes the crankshaft 110 to rotate using a starter motor), and carries out a control switching the position of the spool 72*a* of the OCV 72 from the position W3 (the lock release holding position) to the position W1 (the locking operation position). Because of this, it is possible to crank the crankshaft 110 while putting the regulating bodies 61*a* and 61*b* into a condition that they can be inserted into the stepped portions 62*a* to 62*d* by discharging the lock oil in the stepped portions 62*a* to 62*d* and the hydraulic oil of the advance chamber 41 and retard chamber 42 to the oil pan 74. At this time, the internal rotor 3 flip-flops alternately in the retard direction S1 and advance direction S2 with respect to the external rotor 1 due to a cyclical torque fluctuation (alternating torque) generated in the camshaft 2 in order to drive the inlet valve 21 to open and close. That is, the relative rotation phase of the external rotor 1 and internal rotor 3 fluctuates alternately in the retard direction S1 and advance direction S2. In this case, owing to the rotation operation caused by cranking and the torque fluctuation of the camshaft 2, the average torque generated in the internal rotor 3 is a torque in the retard direction S1, and the relative rotation phase of the external rotor 1 and internal rotor 3 has a tendency to gradually advance in the retard direction S1 while fluctuating alternately in the retard direction S1 and advance direction S2.

Figure 4:
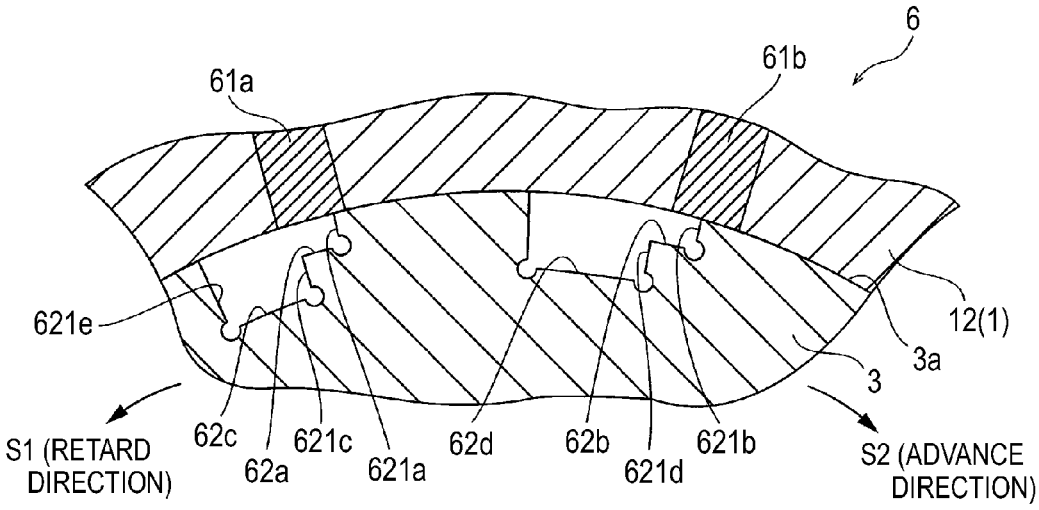
FIG. 4 is a sectional view showing a condition at the start of a locking operation when the relative rotation phase of an external rotor and internal rotor of the valve timing control device according to Embodiment 1 of this disclosure is positioned in a most retarded phase.
Figure 5:
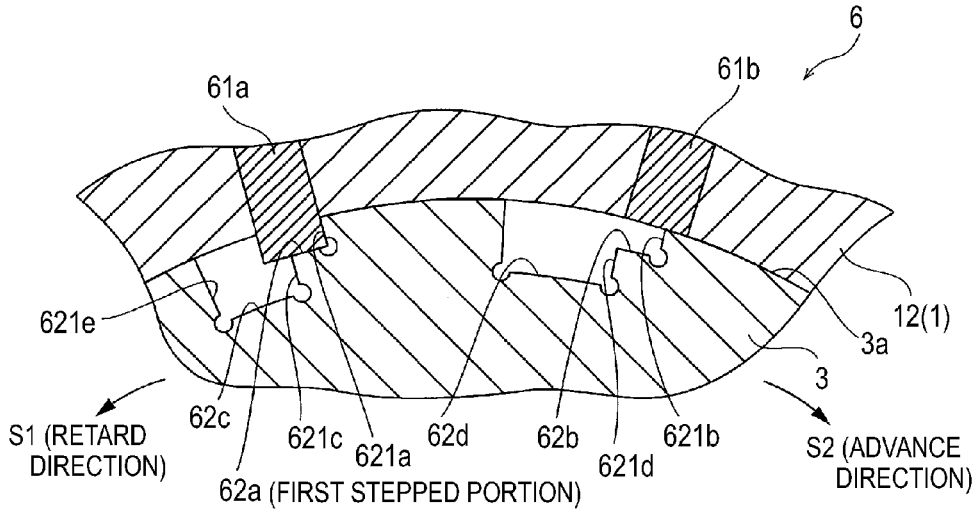
FIG. 5 is a sectional view showing a condition that the relative rotation phase of the external rotor and internal rotor of the valve timing control device according to Embodiment 1 of this disclosure is regulated by a first stepped portion.

Then, on the amount by which the internal rotor 3 flip-flops reaching or exceeding the relative rotation of the first step (the first relative rotation) (relative angle 4 degrees) in the condition of FIG. 4 that the relative rotation phase of the external rotor 1 and internal rotor 3 is positioned in the most retarded phase (relative rotation phase: 0 degrees), the one regulating body 61*a* biased by the spring 63*a* is inserted (moved) into, and engaged with, the first stepped portion 62*a* corresponding to the first step, as shown in FIG. 5. In this condition, the relative rotation phase of the internal rotor 3 with respect to the external rotor 1 is 4 degrees. Herein, as the relative rotation of the first step is set to be the smallest in Embodiment 1, the one regulating body 61*a* is swiftly engaged with the first stepped portion 62*a*. Because of this, in a condition that a relative rotation in the advance direction S2 nearing the lock phase is allowed, the internal rotor 3 is such that a relative rotation in the retard direction S1 moving away from the lock phase is regulated by a wall portion 621*a* of the first stepped portion 62*a* being brought into contact with the regulating body 61*a*. As a result of this, movement of the relative rotation phase of the external rotor 1 and internal rotor 3 in the retard direction S1 moving away from the lock phase is regulated at the phase with a relative rotation phase (relative angle) of 4 degrees in the advance direction S2, with the most retarded phase as a reference.

Figure 6:
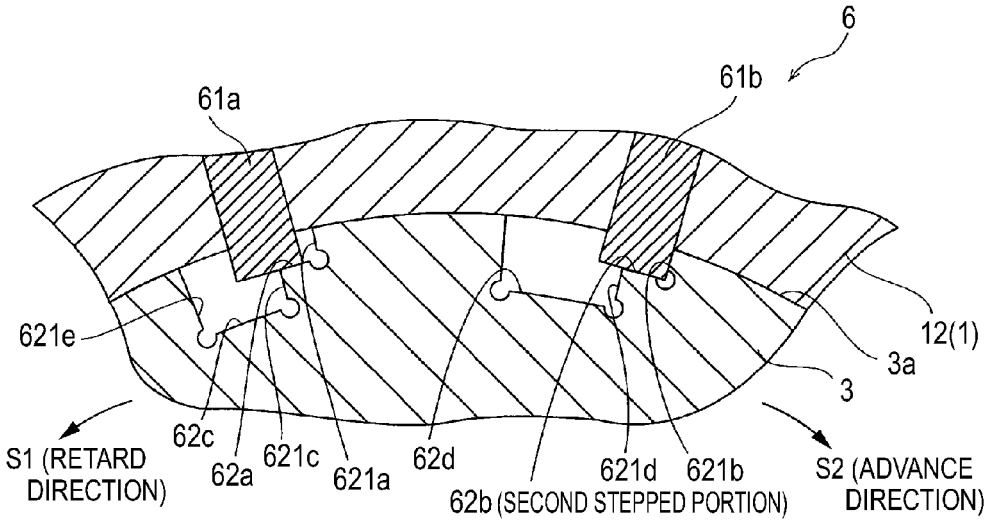
FIG. 6 is a sectional view showing a condition that the relative rotation phase of the external rotor and internal rotor of the valve timing control device according to Embodiment 1 of this disclosure is regulated by a second stepped portion.

On the amount by which the internal rotor 3 flip-flops reaching or exceeding the relative rotation of the second step (the second relative rotation) (relative angle 8 degrees) in the condition that the relative rotation phase of the external rotor 1 and internal rotor 3 (the relative rotation phase of the internal rotor 3 with respect to the external rotor 1) is regulated by the first stepped portion 62*a*, the other regulating body 61*b* biased by the spring 63*b* is inserted into, and engaged with, the second stepped portion 62*b* corresponding to the second step, as shown in FIG. 6. In this condition, the relative rotation phase of the internal rotor 3 with respect to the external rotor 1 is 12 degrees, with the most retarded phase as a reference. At this time, movement of the internal rotor 3 in the retard direction S1 moving away from the lock phase is regulated by a wall portion 621*b* of the second stepped portion 62*b* being brought into contact with the regulating body 61*b* in a position further to the advance direction S2 side than the relative rotation phase regulated by the first stepped portion 62*a*. Because of this, movement of the relative rotation phase of the external rotor 1 and internal rotor 3 in the retard direction S1 moving away from the lock phase is regulated at the phase with a relative rotation phase (relative angle) of 12 degrees in the advance direction S2, with the most retarded phase as a reference.

Figure 7:
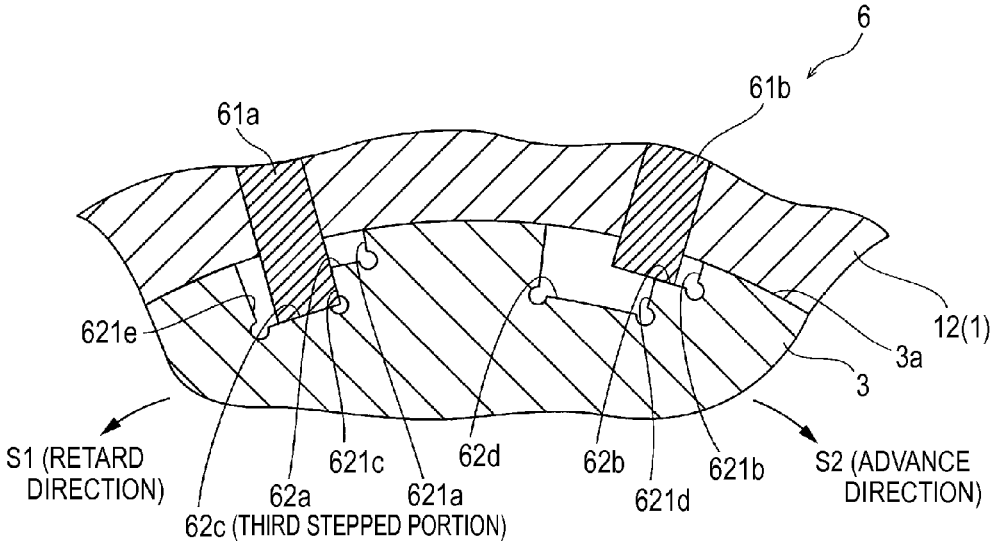
FIG. 7 is a sectional view showing a condition that the relative rotation phase of the external rotor and internal rotor of the valve timing control device according to Embodiment 1 of this disclosure is regulated by a third stepped portion.

On the amount by which the internal rotor 3 flip-flops reaching or exceeding the relative rotation of the third step (the third relative rotation) (relative angle 8 degrees) in this condition, the one regulating body 61*a* is inserted into, and engaged with, the third stepped portion 62*c* corresponding to the third step, as shown in FIG. 7. In this condition, the relative rotation phase of the internal rotor 3 with respect to the external rotor 1 is 20 degrees, with the most retarded phase as a reference. At this time, movement of the internal rotor 3 in the retard direction S1 moving away from the lock phase is regulated by a wall portion 621*c* of the third stepped portion 62*c* being brought into contact with the regulating body 61*a* in a position further to the advance direction S2 side than the relative rotation phase regulated by the second stepped portion 62*b*. Because of this, movement of the relative rotation phase of the external rotor 1 and internal rotor 3 in the retard direction S1 moving away from the lock phase is regulated at the phase with a relative rotation phase (relative angle) of 20 degrees in the advance direction S2, with the most retarded phase as a reference.

Figure 8:
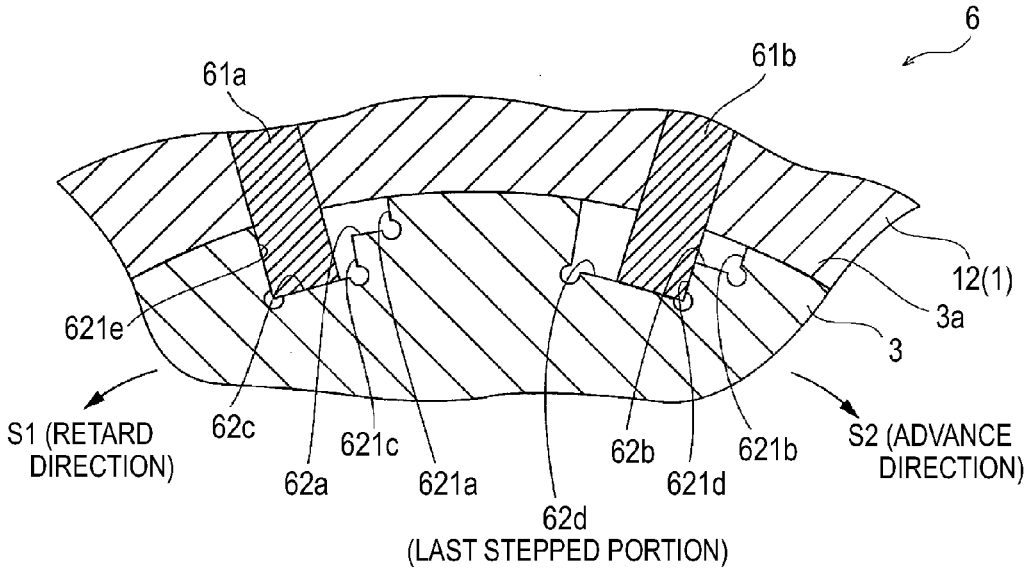
FIG. 8 is a sectional view showing a condition that the relative rotation phase of the external rotor and internal rotor of the valve timing control device according to Embodiment 1 of this disclosure is locked at the lock phase by being regulated by a last stepped portion.

Then, on the amount by which the internal rotor 3 flip-flops reaching or exceeding the relative rotation of the last step (fourth step) (the last relative rotation) (relative angle 8 degrees), the other regulating body 61*b* is inserted into, and engaged with, the last stepped portion 62*d* corresponding to the last step (fourth step), as shown in FIG. 8. In this condition, the relative rotation phase of the internal rotor 3 with respect to the external rotor 1 is 28 degrees (the lock phase), with the most retarded phase as a reference. At this time, the one regulating body 61*a* comes into contact with a wall portion 621*e* of the third stepped portion 62*c*, while the other regulating body 61*b* comes into contact with a wall portion 621*d* of the last stepped portion 62*d*. Because of this, movement of the internal rotor 3 in both the retard direction S1 and advance direction S2 is regulated at the lock phase further to the advance direction S2 side than the relative rotation phase regulated by the third stepped portion 62*c* alone. As a result of this, movement of the relative rotation phase of the external rotor 1 and internal rotor 3 in both the retard direction S1 and advance direction S2 is regulated at the lock phase with a relative rotation phase (relative angle) of 28 degrees in the advance direction S2, with the most retarded phase as a reference. Because of this, the valve timing control device 100 according to Embodiment 1 is such that the relative rotation phase of the external rotor 1 and internal rotor 3 is gradually brought nearer to the lock phase from the most retarded phase when the engine is started up, and locked at the lock phase (28 degrees). By so doing, the locking operation is completed.

In Embodiment 1, as heretofore described, by configuring so that, of the relative rotations of the external rotor 1 and internal rotor 3 from the first step relative rotation (first relative rotation) to the last step relative rotation (last relative rotation), a relative rotation (the first step relative rotation in Embodiment 1) other than the last step relative rotation is the smallest, it is easier for the relative rotation of a step before the last step is to be small compared with when configuring so that the last step relative rotation is the smallest. Because of this, as it is possible to suppress an increase in the amount of flip-flop necessary in order to cause the regulating body to engage with the corresponding stepped portion at a step before the last step, it is possible to cause the regulating body 61*a* (61*b*) to swiftly engage with a stepped portion corresponding to a step before the last step, even when the amount of flip-flop of the internal rotor 3 due to the camshaft 2 torque fluctuation gradually increases from the small condition immediately after the start of cranking (the initial cranking stage). Because of this, it is possible to swiftly bring the relative rotation phase nearer to the lock phase from the most retarded phase, and as a result of this, it is possible to cause the relative rotation phase of the external rotor 1 and internal rotor 3 to swiftly reach the lock phase when starting up the engine 200.

In particular, when setting so that the first step relative rotation (first relative rotation) is the smallest, as in Embodiment 1, it is possible to cause the regulating body 61*a* to swiftly engage with the first stepped portion 62*a* even in the initial cranking stage shortly after the start of cranking, when the amount of flip-flop of the internal rotor 3 is small, because of which it is possible to cause the lock phase to be reached more swiftly.

Also, in Embodiment 1, the configuration is such that the relative rotations of the second step to last step are mutually equal. Because of this, when the amount by which the relative rotation of the first step is the smallest is shared among the other steps, it is possible to share equally among all the steps from the second step onward, because of which, it is possible to prevent the relative rotation of a specific step from becoming excessively large. Because of this, it is possible to prevent it being difficult for the regulating body 61*a* (61*b*) to engage with the stepped portion corresponding to a specific step, and for this reason too, it is possible to cause the relative rotation phase to reach the lock phase more swiftly.

In particular, the configuration of Embodiment 1 is advantageous when the amount of flip-flop due to the camshaft 2 torque fluctuation immediately after the start of cranking is less than the second step relative rotation (second relative rotation), and the amount of flip-flop stabilizes, and can be maintained at or above the second step relative rotation, after the regulating body 61*a* is engaged with the first stepped portion 62*a*.

Embodiment 2

Next, referring to FIG. 11, a description will be given of a valve timing control device 100*a* according to Embodiment 2 disclosed here. In Embodiment 2, unlike Embodiment 1, of the relative rotations of each step from the first step to the last step (fourth step), the first step relative rotation is the smallest, the second step relative rotation is the second smallest, and the third step and last step relative rotations are set to be mutually equal.

Figure 11:
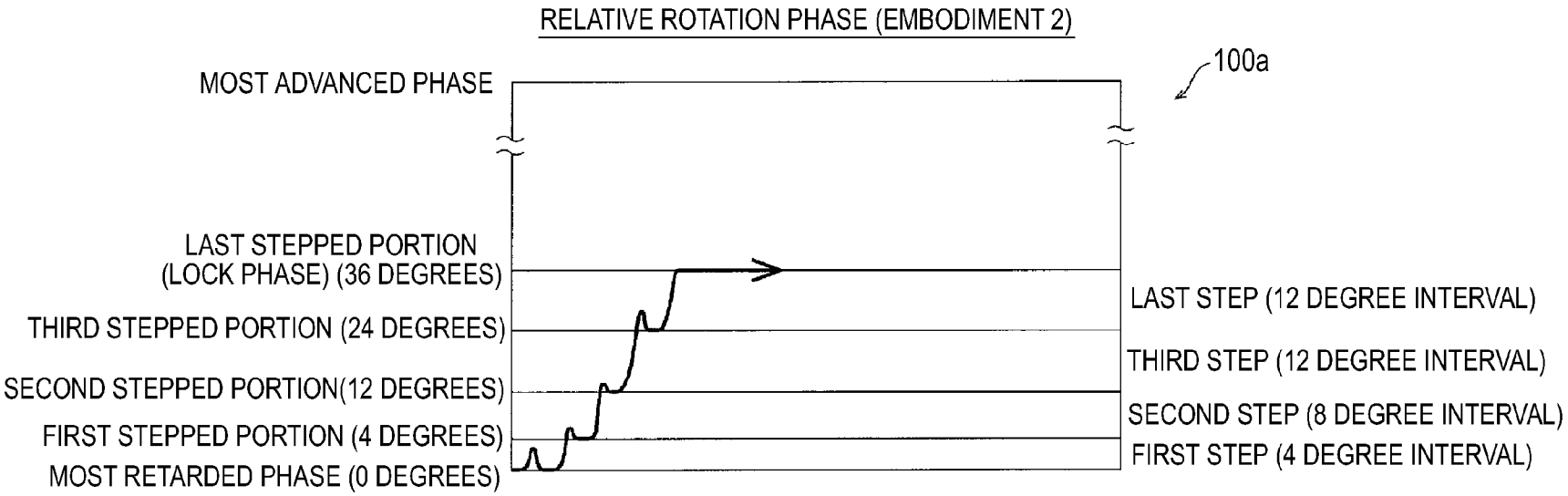
FIG. 11 is a diagram showing the relative rotation of each step of a valve timing control device according to Embodiment 2 of this disclosure.

In Embodiment 2, as shown in FIG. 11, the configuration is such that the relative rotation phase of the external rotor 1 and internal rotor 3 (the relative rotation phase of the internal rotor 3 with respect to the external rotor 1) (refer to FIGS. 2 and 3) reaches the lock phase in four steps, and is locked at the lock phase, when starting up the engine. Also, of the relative rotations of each step from the first step to the last step, with the most retarded phase as a reference, the first step relative rotation (first relative rotation) is set to be the smallest. The first step relative rotation (first relative rotation) is one example of a "first predetermined relative rotation" disclosed here. Also, the second step relative rotation (second relative rotation) is twice the size of the first step relative rotation, and is set to be the second smallest of the relative rotations of each step from the first step to the last step. Also, the third step and last step relative rotations are three times the size of the first step relative rotation, and are set to be mutually equal. Specifically, the first step relative rotation is of a relative angle (phase difference) of 4 degrees, the second step relative rotation is of a relative angle of 8 degrees, and the third step and last step relative rotations are each of a relative angle of 12 degrees. Also, the lock phase is at 36 degrees.

Other configurations of Embodiment 2 are the same as in Embodiment 1.

In Embodiment 2, as it is possible to reduce the relative rotations of the initial stage steps by configuring so that the first step relative rotation (first relative rotation) is the smallest and the second step relative rotation (second relative rotation) is the second smallest, as heretofore described, it is possible to cause the regulating body 61*a* (61*b*) to engage swiftly with the stepped portions of the initial stage steps, even in the initial cranking stage in which the amount of flip-flop of the internal rotor 3 is small, as a result of which, it is possible to cause the lock phase to be reached more swiftly. Also, the configuration is such that the third step and last step relative rotations are mutually equal. As it is possible because of this to share the amount by which the first step and second step relative rotations are reduced equally between the third step and last step, neither the third step nor last step relative rotation becomes excessively large, and it becomes easier for the regulating body 61*a* (61*b*) to engage with the stepped portions of the third step and last step, as a result of which, it is possible to cause the relative rotation phase to reach the lock phase more swiftly.

In particular, the configuration of Embodiment 2 is advantageous when the amount of flip-flop due to the camshaft 2 torque fluctuation immediately after the start of cranking is less than the second step relative rotation (second relative rotation), the amount of flip-flop immediately after the regulating body 61*a* is engaged with the first stepped portion 62*a* is equal to or greater than the second step relative rotation and less than the third step relative rotation (third relative rotation), and the amount of flip-flop stabilizes, and can be maintained at or above the third step relative rotation, after the regulating body 61*b* is engaged with the second stepped portion 62*b*.

Also, the configuration of Embodiment 2 too, in the same way as that in Embodiment 1, is such that it is possible to cause the regulating body 61*a* (61*b*) to engage swiftly with a stepped portion corresponding to a stepped portion before the last step by configuring so that the relative rotation of a step (the first step) other than the last step is the smallest, because of which, it is possible to cause the relative rotation phase of the external rotor 1 and internal rotor 3 to reach the lock phase swiftly when starting up the engine 200.

Other advantages of Embodiment 2 are the same as those of Embodiment 1.

Embodiment 3

Next, referring to FIG. 12, a description will be given of a valve timing control device 100*b* according to Embodiment 3 disclosed here. In Embodiment 3, unlike Embodiment 1, of the relative rotations of each step from the first step to the last step (fourth step), the relative rotations are set so as to increase sequentially from the first step to the last step.

Figure 12:
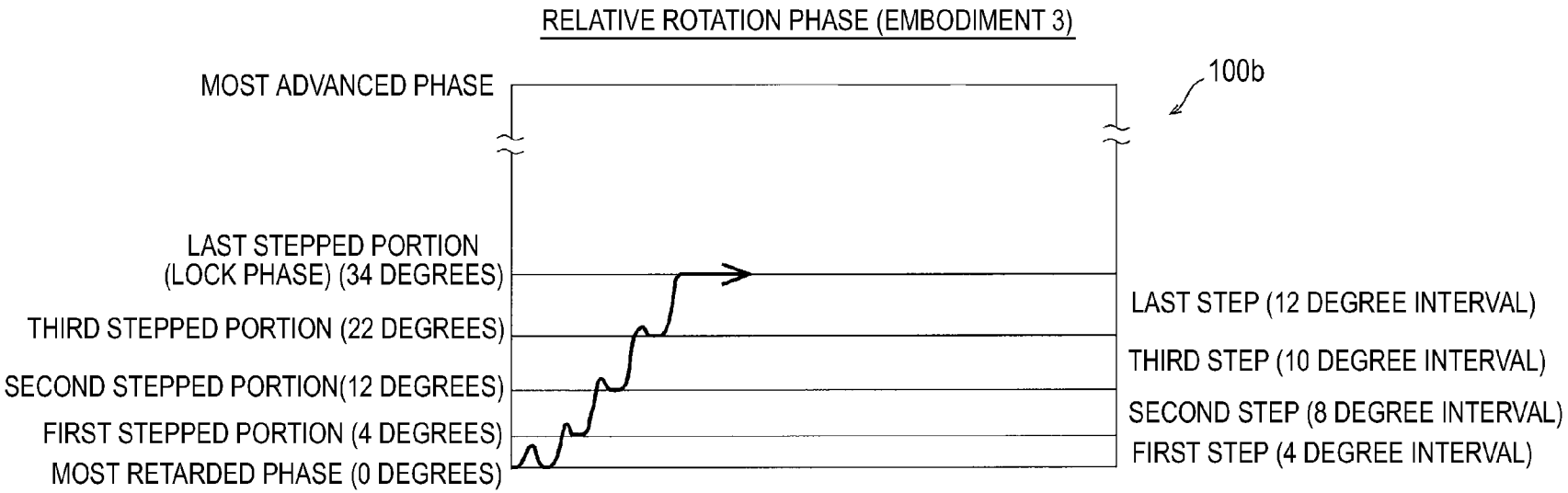
FIG. 12 is a diagram showing the relative rotation of each step of a valve timing control device according to Embodiment 3 of this disclosure.

In Embodiment 3, as shown in FIG. 12, the configuration is such that the relative rotation phase of the external rotor 1 and internal rotor 3 (the relative rotation phase of the internal rotor 3 with respect to the external rotor 1) (refer to FIGS. 2 and 3) reaches the lock phase in four steps, and is locked at the lock phase, when starting up the engine. Also, of the relative rotations of each step from the first step to the last step, with the most retarded phase as a reference, the first step relative rotation (first relative rotation) is the smallest, and the relative rotations are set so as to increase sequentially from the first step to the last step. Specifically, the second step, third step, and last step relative rotations are set to be twice, 2.5 times, and 3 times respectively the size of the first step relative rotation. Specifically, the first step relative rotation is of a relative angle (phase difference) of 4 degrees, the second step relative rotation (second relative rotation) is of a relative angle of 8 degrees, the third step relative rotation (third relative rotation) is of a relative angle of 10 degrees, and the last step relative rotation (last relative rotation) is of a relative angle of 12 degrees. Also, the lock phase is at 34 degrees. The first step relative rotation (first relative rotation) is one example of a "first predetermined relative rotation" disclosed here, and the last step relative rotation (last relative rotation) is one example of a "second predetermined relative rotation" disclosed here.

Other configurations of Embodiment 3 are the same as in Embodiment 1.

In Embodiment 3, as heretofore described, the configuration is such that the relative rotation increases sequentially from the first step to the last step. Because of this, as the relative rotation can be increased sequentially in steps from the first step, which has the smallest relative rotation, it is possible to efficiently bring the relative rotation phase nearer to the lock phase from the most retarded phase by effectively utilizing the tendency for the amount of flip-flop due to the camshaft 2 torque fluctuation to increase gradually. Also, by sequentially increasing the relative rotation, it is possible to easily cause the relative rotation phase to reach the lock phase, even when the phase difference from the most retarded phase to the lock phase is large.

In particular, the configuration of Embodiment 3 is advantageous when the amount of flip-flop due to the camshaft 2 torque fluctuation immediately after the start of cranking is less than the second step relative rotation (second relative rotation), the amount of flip-flop immediately after the regulating body 61*a* is engaged with the first stepped portion 62*a* is equal to or greater than the second step relative rotation and less than the third step relative rotation (third relative rotation), the amount of flip-flop immediately after the regulating body 61*b* is engaged with the second stepped portion 62*b* is equal to or greater than the third step relative rotation and less than the last step (fourth step) relative rotation (last relative rotation), and the amount of flip-flop stabilizes, and can be maintained at or above the last step relative rotation, after the regulating body 61*a* is engaged with the third stepped portion 62*c*.

Also, the configuration of Embodiment 3 too, in the same way as that in Embodiment 1, is such that it is possible to cause the regulating body 61*a* (61*b*) to engage swiftly with a stepped portion corresponding to a stepped portion before the last step by configuring so that the relative rotation of a step (the first step) other than the last step is the smallest, because of which, it is possible to cause the relative rotation phase of the external rotor 1 and internal rotor 3 to reach the lock phase swiftly when starting up the engine 200.

Other advantages of Embodiment 3 are the same as those of Embodiment 1.

Embodiment 4

Next, referring to FIG. 13, a description will be given of a valve timing control device 100*c* according to Embodiment 4 disclosed here. In Embodiment 4, unlike Embodiment 1, of the relative rotations of each step from the first step to the last step (fourth step), the first step and second step relative rotations are mutually equal, and are set to be the smallest.

Figure 13:
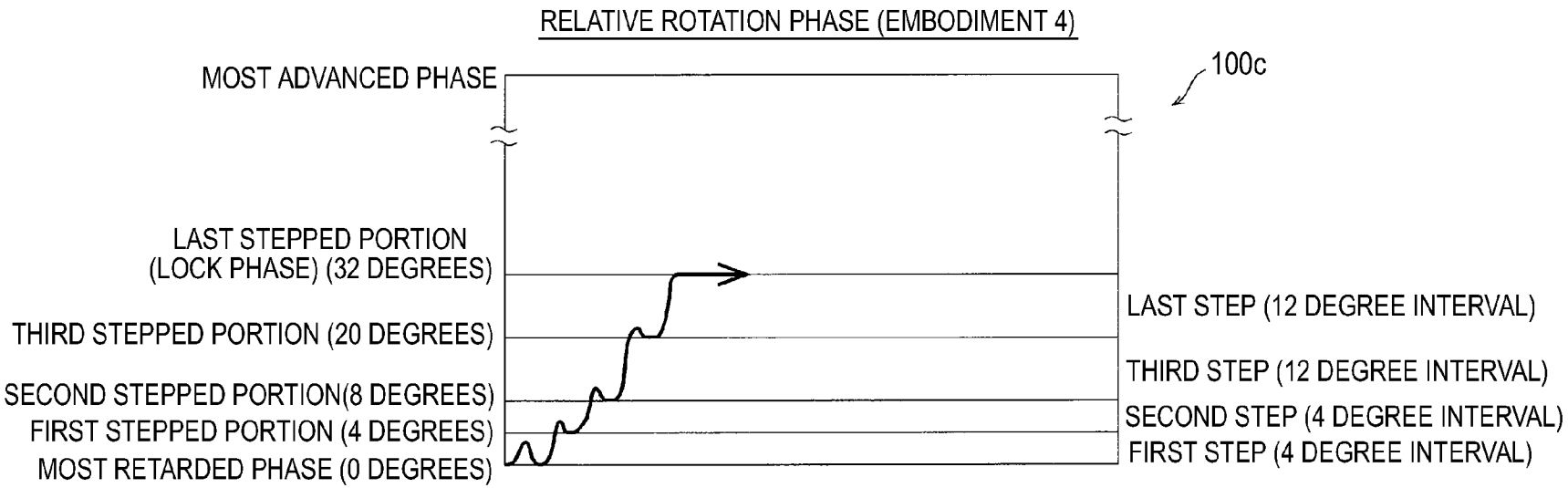
FIG. 13 is a diagram showing the relative rotation of each step of a valve timing control device according to Embodiment 4 of this disclosure.

In Embodiment 4, as shown in FIG. 13, the configuration is such that the relative rotation phase of the external rotor 1 and internal rotor 3 (the relative rotation phase of the internal rotor 3 with respect to the external rotor 1) (refer to FIGS. 2 and 3) reaches the lock phase in four steps, and is locked at the lock phase, when starting up the engine. Also, of the relative rotations of each step from the first step to the last step, with the most retarded phase as a reference, the first step relative rotation (first relative rotation) and second step relative rotation (second relative rotation) are mutually equal, and are set to be the smallest. The first step relative rotation (first relative rotation) and second step relative rotation (second relative rotation) are examples of a "first predetermined relative rotation" disclosed here. Also, the third step and last step relative rotations are 3 times the size of the first step (second step) relative rotation, and are set to be mutually equal. Specifically, the first step and second step relative rotations are each of a relative angle (phase difference) of 4 degrees, and the third step and last step relative rotations are each of a relative angle of 12 degrees. Also, the lock phase is at 32 degrees.

Other configurations of Embodiment 4 are the same as in Embodiment 1.

In Embodiment 4, as heretofore described, the configuration is such that the first step and second step relative rotations are mutually equal, and in addition to the first step, the relative rotation of the second step is also the smallest. Because of this, it is possible to cause the regulating body 61*a* (61*b*) to more swiftly engage with the initial stage stepped portions of the first step and second step, even when the amount of flip-flop due to the camshaft 2 torque fluctuation is in the small condition immediately after the start of cranking (the initial cranking stage), because of which it is possible to cause the relative rotation phase of the external rotor 1 and internal rotor 3 to more swiftly reach the lock phase. Also, the third step and last step relative rotations are configured to be mutually equal. As it is possible because of this to share the amount by which the first step and second step relative rotations are reduced equally between the third step and last step, neither the third step nor last step relative rotation becomes excessively large, and it becomes easier for the regulating body 61*a* (61*b*) to engage with the stepped portions of the third step and last step, as a result of which, it is possible to cause the relative rotation phase to reach the lock phase more swiftly.

Also, the configuration of Embodiment 4 too, in the same way as that in Embodiment 1, is such that it is possible to cause the regulating body 61*a* (61*b*) to engage swiftly with a stepped portion corresponding to a stepped portion before the last step by configuring so that the relative rotation of a step (the first step) other than the last step is the smallest.

Other advantages of Embodiment 4 are the same as those of Embodiment 1.

Embodiment 5

Next, referring to FIG. 14, a description will be given of a valve timing control device 100*d* according to Embodiment 5 disclosed here. Firstly, before describing the details of the valve timing control device 100*d* according to Embodiment 5, a description will be given of technology that forms a premise of Embodiment 5.

Heretofore, technology has been known whereby it is predicted whether or not an engine stalling (a sudden stopping of the engine) will occur, and when it is predicted that an engine stalling will occur, a control moving the relative rotation phase of the crankshaft (drive side rotating member) and inlet side camshaft (driven side rotating member) to an initial phase (lock phase) appropriate to starting up the engine, and shifting the gear mechanism into a neutral condition so that the engine does not stop, is carried out (for example, refer to JP 2012-13051 A).

However, with the heretofore known configuration described above, it can be supposed that the engine might stall before the gear mechanism is in the neutral condition, in which case, it may not be possible to cause the relative rotation phase of the crankshaft and inlet side camshaft to reach the initial phase (lock phase).

Therefore, in Embodiment 5, a description will be given of a configuration such that the engine can be easily restarted when the engine has stalled, even when it is not possible to cause the relative rotation phase of the external rotor 1 and internal rotor 3 to reach a lock phase appropriate to starting up the engine (an abnormal time). In Embodiment 5, unlike Embodiment 1, of the relative rotations of each step from the first step to the last step (fourth step), the first step relative rotation (first relative rotation) is the smallest, and the last step relative rotation (last relative rotation) is set to be the second smallest. The first step relative rotation (first relative rotation) is one example of a "first predetermined relative rotation" disclosed here.

Figure 14:
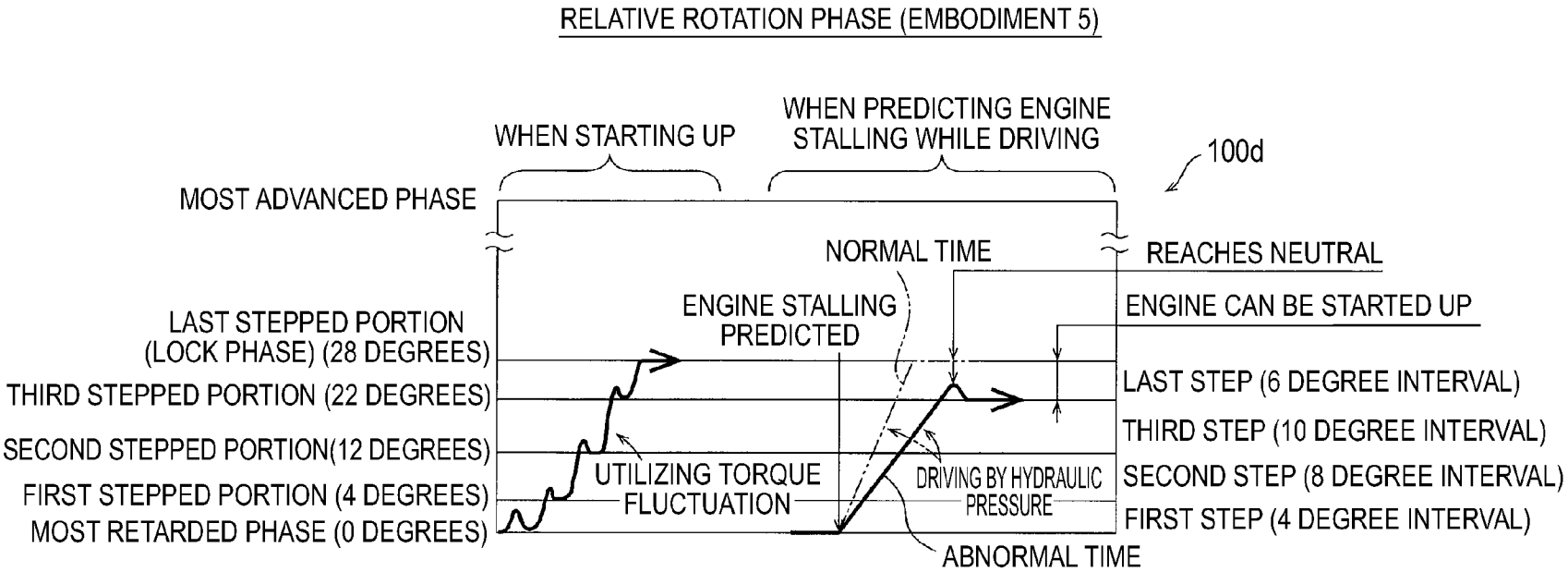
FIG. 14 is a diagram showing the relative rotation of each step of a valve timing control device according to Embodiment 5 of this disclosure.

In Embodiment 5, as shown in FIG. 14, the configuration is such that the relative rotation phase of the external rotor 1 and internal rotor 3 (the relative rotation phase of the internal rotor 3 with respect to the external rotor 1) (refer to FIGS. 2 and 3) reaches the lock phase in four steps, and is locked at the lock phase, when starting up the engine. Also, when it is predicted that an engine stalling will occur, an unshown gear mechanism is shifted into a neutral condition so that the engine 200 does not stop. Also, the valve timing control device 100*d* according to Embodiment 5 is configured so that, utilizing the hydraulic pressure of the hydraulic oil of the hydraulic chamber 4 (refer to FIGS. 2 and 3), the relative rotation phase of the external rotor 1 and internal rotor 3 is moved to a lock phase appropriate to starting up the engine in the event that it is predicted that an engine stalling will occur when the engine is operating (while driving). Because of this, as shown by the two-dot chain line in FIG. 14, it is possible to cause the relative rotation phase of the external rotor 1 and internal rotor 3 to reach the lock phase before the engine 200 stops.

Also, in Embodiment 5, of the relative rotations of each step from the first step to the last step, with the most retarded phase as a reference, the first step relative rotation (first relative rotation) is the smallest, and the relative rotations are set so as to increase sequentially from the first step to the third step, which is one before the last step. The third step relative rotation (third relative rotation) is one example of a "second predetermined relative rotation" disclosed here. Also, of the relative rotations of each step from the first step to the last step, the last step relative rotation (last relative rotation) is set to be the second smallest. That is, although the last step relative rotation is larger than the first step relative rotation, which is set to be the smallest taking into consideration the amount of flip-flop of the internal rotor 3 due to the camshaft 2 torque fluctuation, the last step relative rotation is set to be smaller than the second step and third step relative rotations.

Also, by the last step relative rotation being set to be the second smallest, as heretofore described, the range of the relative rotation phase corresponding to the last step relative rotation (from the third relative rotation phase to the lock phase) is set to a range of the relative rotation phase in which the engine 200 can be started up. Also, the relative rotations of each step from the first step to the last step are set taking into consideration the time from the occurrence of an engine stalling being predicted until the gear mechanism is shifted into a neutral condition, response speed when the relative rotation phase of the external rotor 1 and internal rotor 3 is moved by hydraulic pressure to the lock phase, the range of the relative rotation phase in which the engine can be started up, and the like. Specifically, the first step relative rotation is of a relative angle (phase difference) of 4 degrees, while the second step relative rotation (second relative rotation) is of a relative angle of 8 degrees, twice the size of the first step relative rotation. Also, the third step relative rotation (third relative rotation) is of a relative angle of 10 degrees, 2.5 times the size of the first step relative rotation, and the last step relative rotation is of a relative angle of 6 degrees, 1.5 times the size of the first step relative rotation. Also, the lock phase is at 28 degrees.

Other configurations of Embodiment 5 are the same as in Embodiment 1.

In Embodiment 5, as heretofore described, the configuration is such that the first step relative rotation (first relative rotation) is the smallest, and the last step relative rotation (last relative rotation) is the second smallest. As it is possible, because of this, to reduce the relative rotation (phase difference) corresponding to the last step from the penultimate stepped portion (third stepped portion) 62*c* to the last stepped portion (fourth stepped portion) 62*d*, it is possible to regulate the relative rotation phase at a position nearer a lock phase (a relative rotation phase at the last stepped portion) appropriate to starting up the engine when the regulating body 61*a* engages with the penultimate stepped portion 62*c*. Because of this, even when the engine 200 stops before the gear mechanism is in a neutral condition, and it is not possible to cause the relative rotation phase of the external rotor 1 and internal rotor 3 to reach a lock phase appropriate to starting up the engine (an abnormal time), it is possible to easily restart the engine 200 provided that the relative rotation phase is in a condition that it is regulated by the penultimate stepped portion 62*c*.

Also, in Embodiment 5, as heretofore described, the range of the relative rotation phase corresponding to the last step relative rotation (last relative rotation) (from the third relative rotation phase to the lock phase) is set as the range of the relative rotation phase in which the engine 200 can be started up. Because of this, even in a condition that the relative rotation phase has not reached the lock phase, it is possible to reliably and smoothly start up the engine 200 provided that the relative rotation phase is in a condition that it is regulated by the penultimate stepped portion (third stepped portion) 62*c*.

Also, the configuration of Embodiment 5 too, in the same way as that in Embodiment 1, is such that it is possible to cause the regulating body 61*a* (61*b*) to engage swiftly with a stepped portion corresponding to a stepped portion before the last step by configuring so that the relative rotation of a step (the first step) other than the last step is the smallest, because of which, it is possible to cause the relative rotation phase of the external rotor 1 and internal rotor 3 to swiftly reach the lock phase when starting up the engine 200.

Other advantages of Embodiment 5 are the same as those of Embodiment 1.

Embodiment 6

Next, referring to FIG. 15, a description will be given of a valve timing control device 100*e* according to Embodiment 6 disclosed here. In Embodiment 6, unlike Embodiment 1, the relative rotation phase corresponding to the stepped portion 62*c* of the penultimate third step is set to a relative rotation phase at which it is possible to start up the engine 200.

Figure 15:
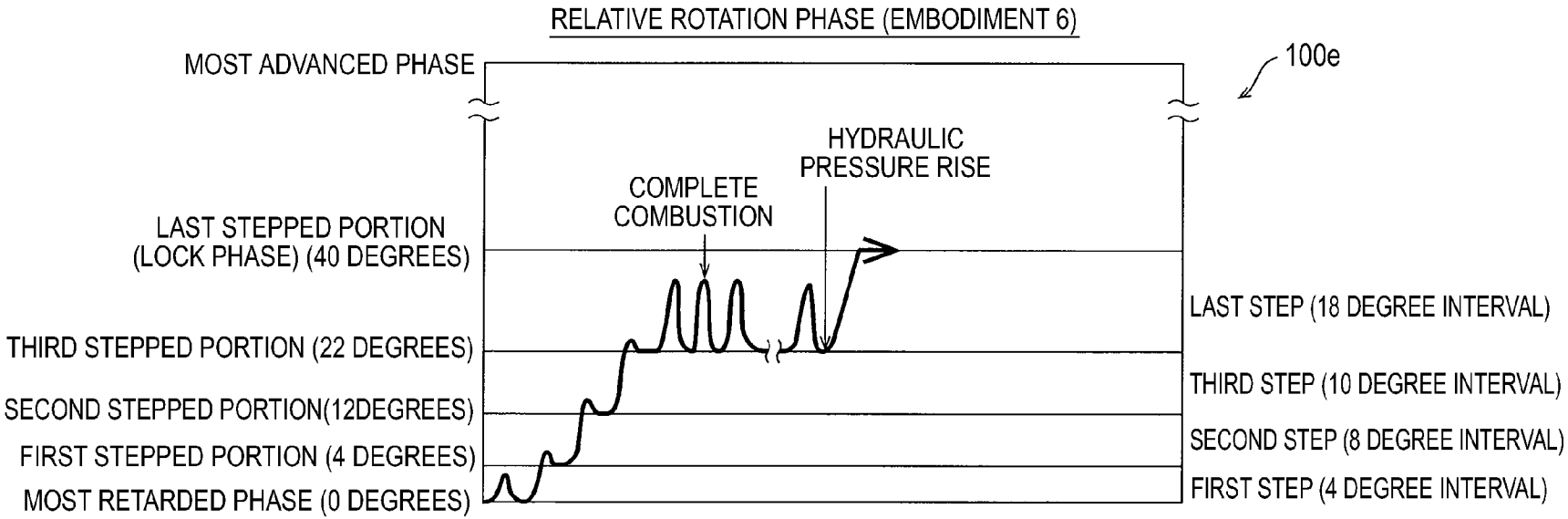
FIG. 15 is a diagram showing the relative rotation of each step of a valve timing control device according to Embodiment 6 of this disclosure.

In Embodiment 6, as shown in FIG. 15, the configuration is such that the relative rotation phase of the external rotor 1 and internal rotor 3 (the relative rotation phase of the internal rotor 3 with respect to the external rotor 1) (refer to FIGS. 2 and 3) reaches the lock phase in four steps, and is locked at the lock phase, when starting up the engine. Also, of the relative rotations of each step from the first step to the last step, with the most retarded phase as a reference, the first step relative rotation (first relative rotation) is the smallest, and the relative rotations are set so as to increase sequentially from the first step to the last step. That is, of the relative rotations of each step from the first step to the last step, the last step relative rotation (last relative rotation) is set to be the largest. Specifically, the second step, third step, and last step relative rotations are set to be twice, 2.5 times, and 4.5 times respectively the size of the first step relative rotation. Specifically, the first step relative rotation is of a relative angle (phase difference) of 4 degrees, and the second step relative rotation (second relative rotation) is of a relative angle of 8 degrees. Also, the third step relative rotation (third relative rotation) is of a relative angle of 10 degrees, and the last step relative rotation is of a relative angle of 18 degrees. Also, the lock phase is at 40 degrees. The first step relative rotation (first relative rotation) is one example of a "first predetermined relative rotation" disclosed here, and the last step relative rotation (last relative rotation) is one example of a "second predetermined relative rotation" disclosed here.

Also, the relative rotation phase (third relative rotation phase) corresponding to the penultimate third stepped portion 62*c*, which is the relative rotation phase forming the starting point of the last step, is set to a relative rotation phase at which it is possible to start up the engine 200. Specifically, the relative rotation phase corresponding to the third stepped portion 62*c* is set to a phase at which complete combustion is possible in the engine 200 (the engine 200 can spontaneously drive without a starter motor), even when the temperature is extremely low (approximately −30° C.). Because of this, after the relative rotation phase of the external rotor 1 and internal rotor 3 moves to the relative rotation phase corresponding to the third stepped portion 62*c*, the engine 200 is started, and the hydraulic pressure of the hydraulic chamber 4 can be utilized, because of which, it is possible to easily move the relative rotation phase of the external rotor 1 and internal rotor 3 using the hydraulic pressure. Further, the valve timing control device 100*e* according to Embodiment 6 is configured so that, when starting up the engine, the relative rotation phase of the external rotor 1 and internal rotor 3 is moved from the most retarded phase to the relative rotation phase corresponding to the penultimate third stepped portion 62*c* using the camshaft 2 torque fluctuation, and after the engine 200 is started up, the relative rotation phase is moved from the relative rotation phase corresponding to the third stepped portion 62*c* to the lock phase using the hydraulic pressure.

Also, the relative rotation phases corresponding to the stepped portions (the first stepped portion 62*a* and second stepped portion 62*b*) further to the retard direction side than the penultimate third stepped portion 62*c*, at which the engine can be started up, are set to relative rotation phases at which the engine either cannot be started up when the temperature is extremely low (approximately −30° C.) or, even in the event that the engine is started up, it takes on a rough idling condition (a condition that the vibration of the engine 200 is more severe than when the engine 200 starts up normally). That is, when the temperature is extremely low, it is not possible to start up the engine normally at the relative rotation phases corresponding to the first stepped portion 62*a* and second stepped portion 62*b*.

Other configurations of Embodiment 6 are the same as in Embodiment 1.

In Embodiment 6, as heretofore described, the configuration is such that the last step relative rotation (last relative rotation) is the largest. As it is possible, because of this, to reduce the relative rotation of a step before the last step by the amount by which the last step relative rotation is increased, it is possible to further suppress an increase in the amount of flip-flop necessary to cause the regulating body 61*a* (61*b*) to engage with the corresponding stepped portion at the step before the last step. Because of this, it is possible to swiftly bring the relative rotation phase nearer to the lock phase from the most retarded phase, even when the amount of flip-flop of the internal rotor 3 due to the camshaft 2 torque fluctuation gradually increases from the small condition immediately after the start of cranking.

Also, in Embodiment 6, as heretofore described, the relative rotation phase (third relative rotation phase) corresponding to the penultimate third stepped portion (third stepped portion) 62*c* is set to a relative rotation phase at which it is possible to start up the engine 200. Further, when starting up the engine 200, the relative rotation phase is moved from the most retarded phase to the relative rotation phase corresponding to the penultimate stepped portion 62*c* using the camshaft 2 torque fluctuation, and after the engine 200 is started up, the relative rotation phase is moved from the relative rotation phase corresponding to the penultimate stepped portion 62*c* to the lock phase using the hydraulic pressure. Because of this, when the last step relative rotation is the largest, the regulating body 61*a* (61*b*) can engage with a smaller amount of flip-flop at each relative rotation phase from the most retarded phase to the relative rotation phase corresponding to the penultimate stepped portion 62*c*, because of which, it is possible to swiftly bring the relative rotation phase nearer to the lock phase utilizing the camshaft 2 torque fluctuation. Also, it is possible to reliably cause the relative rotation phase to reach the lock phase by utilizing the hydraulic pressure from the relative rotation phase corresponding to the penultimate stepped portion 62*c* to the lock phase.

Also, the configuration of Embodiment 6 too, in the same way as that in Embodiment 1, is such that it is possible to cause the regulating body 61*a* (61*b*) to engage swiftly with a stepped portion corresponding to a stepped portion before the last step by configuring so that the relative rotation of a step (the first step) other than the last step is the smallest, because of which, it is possible to cause the relative rotation phase of the external rotor 1 and internal rotor 3 to swiftly reach the lock phase when starting up the engine 200.

Other advantages of Embodiment 6 are the same as those of Embodiment 1.

It can be supposed that the embodiments disclosed here are examples in all aspects, and are not limiting. The range disclosed here is indicated by the range of the claims rather than by the description of the embodiments, and furthermore, all changes within the range of the claims and equivalent meanings and ranges are included.

For example, in Embodiments 1 to 6, a camshaft that opens and closes the engine inlet valve is shown as an example of the camshaft disclosed here, but this disclosure is not limited to this. In this disclosure, the camshaft may be one that opens and closes the engine exhaust valve, or the camshaft may be one that opens and closes both the inlet valve and exhaust valve.

Also, in Embodiments 1 to 6, an example in which among the relative rotations of each step from the first step to the last step (fourth step), the first step relative rotation (first relative rotation) is set to be the smallest is given, but this disclosure is not limited to this. In this disclosure, of the relative rotations of each step from the first step to the last step, the relative rotation of a step other than the first step may be set to be the smallest, provided that it is a relative rotation other than the last step relative rotation. For example, the relative rotation of the second step or third step may be configured to be the smallest.

Also, in Embodiments 1 to 6, an example in which the regulating body is caused to engage with the stepped portion by being moved in the radial direction of the internal rotor (the driven side rotating member) is given, but this disclosure is not limited to this. In this disclosure, the regulating body may be caused to engage with the stepped portion by being moved in the direction in which the rotation axis of the driven side rotating member extends.

Also, in Embodiments 1 to 6, an example in which the regulating body is provided in the external rotor (the drive side rotating member) and the stepped portion is provided in the internal rotor (the driven side rotating member) is given, but this disclosure is not limited to this. In this disclosure, the regulating body may be provided in the driven side rotating member and the stepped portion in the drive side rotating member.

Also, in Embodiments 1 to 6, an example in which the relative rotation phase of the external rotor (the drive side rotating member) and internal rotor (the driven side rotating member) is caused to reach the lock phase from the most retarded phase in four steps is given, but this disclosure is not limited to this. In this disclosure, provided that the configuration is such that regulation from the most retarded phase to the lock phase is gradual, the relative rotation phase of the drive side rotating member and driven side rotating member may be caused to reach the lock phase from the most retarded phase in a number of steps other than four. For example, the relative rotation phase of the drive side rotating member and driven side rotating member may be caused to reach the lock phase from the most retarded phase in six steps, as in a valve timing control device 100*f* according to a modification example shown in FIG. 16. When causing the relative rotation phase to reach the lock phase in six steps in this way, it is possible to cause the relative rotation phase to reach the lock phase more easily in comparison with when causing the relative rotation phase to reach the lock phase in four steps, commensurate with the increase in steps, even when the phase difference from the most retarded phase to the lock phase is large (the phase difference is set to 58 degrees in FIG. 16).

Figure 16:
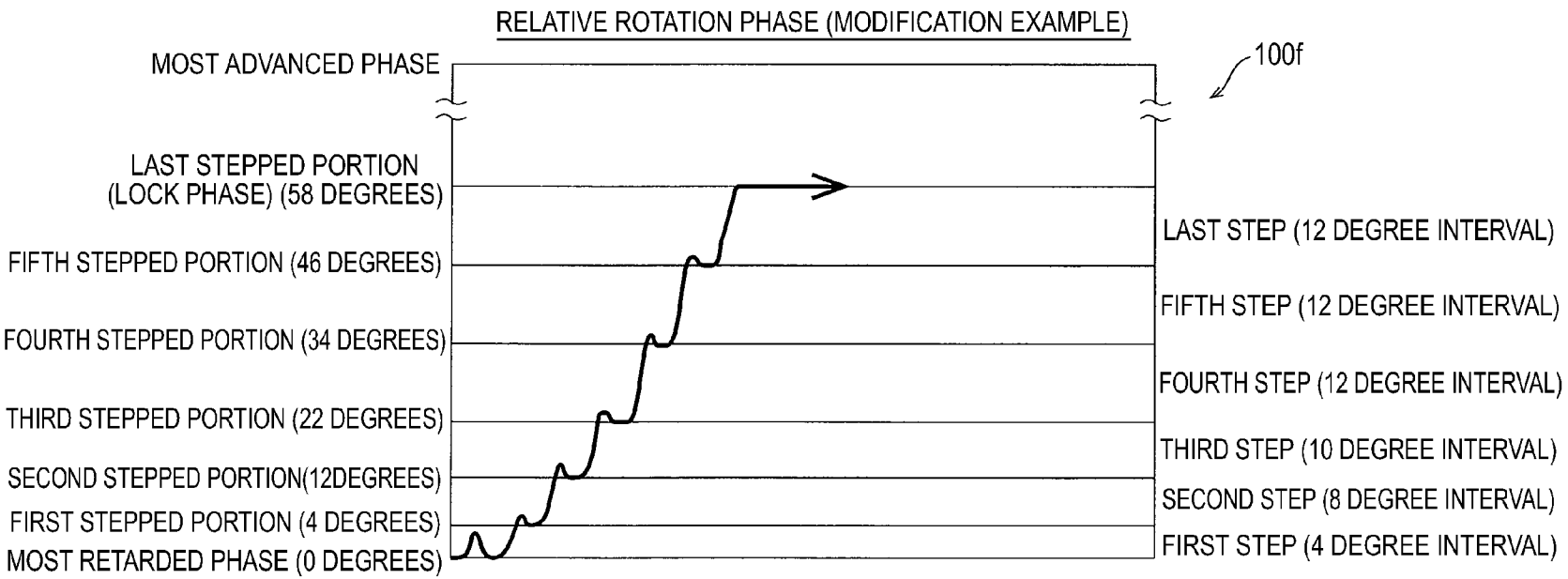
FIG. 16 is a diagram showing the relative rotation of each step of a valve timing control device according to a modification example of Embodiment 1 of this disclosure.

Also, in the modification example, of the relative rotations from the first step to the last step (sixth step), the first step relative rotation (first relative rotation) is the smallest (4 degrees), and the relative rotations are set so as to increase sequentially from the first step to the fourth step (second step (8 degrees), third step (10 degrees), fourth step (12 degrees)), as shown in FIG. 16. As it is possible to reduce the relative rotations of the initial stage steps (first step and second step) by configuring in this way, it is possible to cause the regulating body to engage swiftly with the stepped portions of the initial stage steps, even in the initial cranking stage in which the amount of flip-flop is small, as a result of which it is possible to cause the lock phase to be reached more swiftly. Also, as the relative rotation can be increased sequentially in steps from the first step, which has the smallest relative rotation, to the fourth step, it is possible to efficiently bring the relative rotation phase nearer to the lock phase from the most retarded phase by effectively utilizing the tendency for the amount of flip-flop due to the camshaft torque fluctuation to increase gradually. Also, by the relative rotations from the fourth step to the last step being mutually equal (12 degrees), it is possible to share the amount by which the first step to third step relative rotations are reduced equally among the steps from the fourth step to the last step, because of which, the relative rotations of the fourth step onward do not become excessively large, and it becomes easier for the regulating body to engage with the stepped portions of the fourth step onward, as a result of which, it is possible to cause the relative rotation phase to reach the lock phase more swiftly.

In particular, the configuration of the modification example shown in FIG. 16 is advantageous when the amount of flip-flop due to the camshaft torque fluctuation immediately after the start of cranking is less than the second step relative rotation (second relative rotation) (relative angle 8 degrees), the amount of flip-flop immediately after the regulating body is engaged with the first stepped portion is equal to or greater than the second step relative rotation and less than the third step relative rotation (third relative rotation) (relative angle 10 degrees), the amount of flip-flop immediately after the regulating body is engaged with the second stepped portion is equal to or greater than the third step relative rotation and less than the fourth step relative rotation (fourth relative rotation) (relative angle 12 degrees), and the amount of flip-flop stabilizes, and can be maintained at or above the fourth step relative rotation, after the regulating body is engaged with the third stepped portion.

When increasing the number of steps, as in the modification example shown in FIG. 16, it is possible to obtain an advantage in that it is possible to cause the lock phase to be reached more easily, commensurate with the increase in steps, but on the other hand, the structure becomes more complex due to an increase in stepped portions. As opposed to this, Embodiments 1 to 6 are such that, by reducing the number of steps from the most retarded phase to the lock phase to four, it is possible to simplify the structure in comparison with when there are a large number of steps, as there is no need to increase the number of stepped portions, and it is thus possible to suppress an increase in the size of the locking mechanism.

Also, in Embodiments 1 to 6, an example is given of a configuration that the relative rotation phase of the external rotor (the drive side rotating member) and internal rotor (the driven side rotating member) is caused to reach the lock phase from the most retarded phase in steps, but this disclosure is not limited to this. In this disclosure, the relative rotation phase of the drive side rotating member and driven side rotating member may be caused to reach the lock phase from the most advanced phase in steps. That is, this disclosure is also applicable to a configuration that, in a condition that the hydraulic pressure of the hydraulic oil for controlling the relative rotation phase of the drive side rotating member and driven side rotating member is not exerted, the relative rotation phase is forcibly moved to the most advanced phase by the biasing force of a torsion spring, or the like.

Also, in Embodiments 1 to 6, an example is given of a configuration that the relative rotation phase is caused to reach the lock phase from the most retarded phase in steps using the pair of regulating bodies, but this disclosure is not limited to this. In this disclosure, provided that the relative rotation phase can be caused to reach the lock phase from the most retarded phase in steps, the configuration may be such that the relative rotation phase is caused to reach the lock phase from the most retarded phase in steps using one, or three or more, regulating bodies.

Therefore, aspects of this disclosure are further described below. According to one aspect of this disclosure, there is provided a valve timing control device including a drive side rotating member that rotates in synchronization with an engine crankshaft, a driven side rotating member, disposed so as to be rotatable relative to the drive side rotating member on the same axis as the drive side rotating member, that rotates together with a camshaft that opens and closes at least one of an inlet valve and exhaust valve of the engine, and a locking mechanism that locks the relative rotation phase of the drive side rotating member and driven side rotating member at a lock phase, in which the locking mechanism includes a regulating body, and n (n is a positive integer) stepped portions with which the regulating body engages, allowing a relative rotation bringing the relative rotation phase nearer to the lock phase and regulating a relative rotation whereby the relative rotation phase is distanced from the lock phase, the relative rotation phase is regulated in steps from a most retarded phase or most advanced phase until reaching the lock phase by the regulating body engaging sequentially with a plurality of stepped portions, and the positional relationship between the stepped portions and regulating body is set so that, of relative rotations from a first relative rotation from the most retarded phase or most advanced phase to a first relative rotation phase regulated by a first stepped portion of the n stepped portions to a last relative rotation from an $n^{th}-1$ relative rotation phase regulated by an $n^{th}-1$ stepped portion of the n stepped portions to a last relative rotation to the lock phase regulated by an $n^{th}$ stepped portion, a first predetermined relative rotation other than the last relative rotation is the smallest.

As heretofore described, the valve timing control device according to the one aspect of this disclosure is such that, by configuring so that, of the relative rotations from the first relative rotation to the last relative rotation of the drive side rotating member and driven side rotating member, a first predetermined relative rotation other than the last relative rotation is the smallest, it is easier for the relative rotation of a step before the last step to be small compared with when configuring so that the last step relative rotation is the smallest. Because of this, as it is possible to suppress an increase in the amount of flip-flop necessary in order to cause the regulating body to engage with the corresponding stepped portion at a step before the last step, it is possible to cause the regulating body to swiftly engage with the stepped portion corresponding to a step before the last step, even when the amount of flip-flop of the driven side rotating member due to the camshaft torque fluctuation gradually increases from the small condition immediately after the start of cranking (the initial cranking stage). Because of this, it is possible to swiftly bring the relative rotation phase nearer to the lock phase from the most retarded phase (most advanced phase), and as a result of this, it is possible to cause the relative rotation phase of the drive side rotating member and driven side rotating member to swiftly reach the lock phase when starting up the engine. In particular, by arranging so that the relative rotations of the initial stage steps, such as the first step and second step, are the smallest, it is possible to cause the regulating body to engage swiftly with the stepped portions of the initial stage steps, even in the initial cranking stage shortly after the start of cranking when the amount of driven side rotating member flip-flop is small, and thus possible to cause the relative rotation phase to more swiftly reach the lock phase.

According to the valve timing control device according to the one aspect of the invention, it is preferable that the first relative rotation is configured so as to be the smallest. By configuring in this way, it is possible to cause the regulating body to engage swiftly with the first stepped portion corresponding to the first step, even when the amount of flip-flop immediately after the start of cranking is at the smallest condition, and thus possible to cause the relative rotation phase to more swiftly reach the lock phase.

In this case, it is preferable that, of the relative rotations from the first relative rotation to the last relative rotation, relative rotations from the first relative rotation to a second predetermined relative rotation are configured so as to increase sequentially. By configuring in this way, it is possible for the relative rotation to be increased sequentially in steps from the first step, which has the smallest relative rotation, because of which, it is possible to efficiently bring the relative rotation phase nearer to the lock phase from the most retarded phase (most advanced phase) by effectively utilizing the tendency for the amount of flip-flop due to the camshaft torque fluctuation to increase gradually. Also, by sequentially increasing the relative rotation, it is possible to easily cause the relative rotation phase to reach the lock phase, even when the phase difference from the most retarded phase (most advanced phase) to the lock phase is large.

According to the configuration that the first relative rotation is the smallest, it is preferable that, of the relative rotations from the first relative rotation to the last relative rotation, a plurality of relative rotations are configured so as to be mutually equal. By configuring in this way, it is possible to share equally when the amount by which the first relative rotation is the smallest is shared among the other steps, because of which, it is possible to prevent the relative rotation of a specific step from becoming excessively large. Because of this, it is possible to prevent it being difficult for the regulating body to engage with the stepped portion corresponding to a specific step, and for this reason too, it is possible to cause the relative rotation phase to reach the lock phase more swiftly. Also, by the relative rotations of the first step and another step (for example, the second step) being mutually equal, and the relative rotation of the other step also being the smallest in addition to that of the first step, it is possible to cause the regulating body to more swiftly engage with the initial stage stepped portions of the first step, second step, and the like.

According to the configuration that the first relative rotation is the smallest, it is preferable that the last relative rotation is configured so as to be the second smallest. By configuring in this way, it is possible to reduce the last relative rotation (phase difference) corresponding to the last step from the $n^{th}-1$ stepped portion to the $n^{th}$ stepped portion, because of which, it is possible to regulate the relative rotation phase at a position nearer a lock phase (a relative rotation phase at the $n^{th}$ stepped portion) appropriate to starting up the engine when the regulating body engages with the $n^{th}-1$ stepped portion. Because of this, even in a condition that the relative rotation phase has not reached the lock phase, it is possible to easily start up the engine provided that the relative rotation phase is in a condition that it is regulated by the $n^{th}-1$ stepped portion.

According to the configuration that the last relative rotation is the second smallest, it is preferable that a range from the $n^{th}-1$ relative rotation phase to the lock phase corresponding to the last relative rotation is set to a relative rotation phase range that it is possible to start up the engine. By configuring in this way, it is possible to start up the engine smoothly, even in a condition that the relative rotation phase has not reached the lock phase, provided that the relative rotation phase is in a condition that it is regulated by the $n^{th}-1$ stepped portion.

According to the valve timing control device according to the one aspect of the invention, it is preferable that the last relative rotation is configured so as to be the largest. By configuring in this way, it is possible to reduce the relative rotation of a step before the last step by the amount by which the last step relative rotation is increased, because of which, it is possible to further suppress an increase in the amount of flip-flop necessary to cause the regulating body to engage with the corresponding stepped portion at the step before the last step. Because of this, it is possible to swiftly bring the relative rotation phase nearer to the lock phase from the most retarded phase (most advanced phase), even when the amount of flip-flop of the driven side rotating member due to the camshaft torque fluctuation gradually increases from the small condition immediately after the start of cranking.

In this case, it is preferable that the $n^{th}-1$ relative rotation phase is set to a relative rotation phase at which it is possible to start up the engine, and the relative rotation phase is configured so as to be moved from the most retarded phase or most advanced phase to the $n^{th}-1$ relative rotation phase by torque fluctuation of the camshaft when starting up the engine, and moved from the $n^{th}-1$ relative rotation phase to the lock phase by hydraulic pressure after the engine is started up. By configuring in this way, when the last relative rotation is the largest, the regulating body can engage with a smaller amount of flip-flop at each relative rotation phase from the most retarded phase (most advanced phase) to the $n^{th}-1$ relative rotation phase corresponding to the $n^{th}-1$ stepped portion, because of which, it is possible to swiftly bring the relative rotation phase nearer to the lock phase utilizing the camshaft torque fluctuation, and it is possible to reliably cause the relative rotation phase to reach the lock phase by utilizing the hydraulic pressure from the $n^{th}-1$ relative rotation phase to the lock phase.

In this disclosure, apart from the valve timing control device according to the heretofore described one aspect, the following kind of configuration is also considered.

Supplementary Note 1

That is, a valve timing control device according to another configuration of this disclosure includes a drive side rotating member that rotates in synchronization with an engine crankshaft, a driven side rotating member, disposed so as to be rotatable relative to the drive side rotating member on the same axis as the drive side rotating member, that rotates together with a camshaft that opens and closes at least one of an inlet valve and exhaust valve of the engine, and a locking mechanism that locks the relative rotation phase of the drive side rotating member and driven side rotating member at a lock phase, that the locking mechanism includes a regulating body, and n (n is a positive integer) stepped portions with which the regulating body engages, allowing a relative rotation bringing the relative rotation phase nearer to the lock phase and regulating a relative rotation whereby the relative rotation phase is distanced from the lock phase, the relative rotation phase is regulated in steps from a most retarded phase or most advanced phase until reaching the lock phase by the regulating body engaging sequentially with a plurality of stepped portions, and the positional relationship between the stepped portions and regulating body is set so that, of relative rotations from a first relative rotation from the most retarded phase or most advanced phase to a first relative rotation phase regulated by a first stepped portion of the n stepped portions to a last relative rotation from an $n^{th}-1$ relative rotation phase regulated by an $n^{th}-1$ stepped portion of the n stepped portions to a last relative rotation to the lock phase regulated by an $n^{th}$ stepped portion, the relative rotations of initial stage steps are the smallest. By configuring in this way, it is possible to cause the regulating body to engage swiftly with the stepped portions of the initial stage steps even in the initial cranking stage in which the amount of driven side rotating member flip-flop is small, and thus possible to cause the relative rotation phase to more swiftly reach the lock phase.

Supplementary Note 2

According to the valve timing control device according to the other configuration of this disclosure, it is preferable that at least one relative rotation of the first relative rotation and a second step second relative rotation, which are initial stage relative rotations, is configured so as to be the smallest. By configuring in this way, it is possible to easily cause the regulating body to engage swiftly with the first step and second step stepped portions, even in the initial cranking stage in which the amount of driven side rotating member flip-flop is small, and thus possible to reliably bring the relative rotation phase nearer to the lock phase from the initial cranking stage.

According to this disclosure, as heretofore described, it is possible to cause the relative rotation phase of a drive side rotating member and driven side rotating member to swiftly reach a lock phase when starting up an engine.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly it is expressly intended that all such variations, changes and equivalents which fall within the spirit and scope of the present invention as defined in the claims, be embraced thereby.

What is claimed is:

1. A valve timing control device, comprising:

a drive side rotating member that rotates in synchronization with an engine crankshaft;

a driven side rotating member, disposed so as to be rotatable relative to the drive side rotating member on the same axis as the drive side rotating member, that rotates together with a camshaft that opens and closes at least one of an inlet valve and exhaust valve of an engine; and a locking mechanism that locks a relative rotation phase of the drive side rotating member and driven side rotating member at a lock phase, wherein the locking mechanism includes a regulating body, and n (n is a positive integer) stepped portions with which the regulating body engages, allowing relative rotation bringing the relative rotation phase nearer to the lock phase and regulating the relative rotation whereby the relative rotation phase is distanced from the lock phase, the relative rotation phase is regulated in steps from a most retarded phase or most advanced phase until reaching the lock phase by the regulating body engaging sequentially with a plurality of stepped portions, and a positional relationship between the stepped portions and the regulating body is set so that among a plurality of the relative rotations, from a first relative rotation from the most retarded phase or most advanced phase to a first relative rotation phase regulated by a first stepped portion of the n stepped portions to a last relative rotation from an $n^{th}-1$ relative rotation phase regulated by an $n^{th}-1$ stepped portion of the n stepped portions to the lock phase regulated by an $n^{th}$ stepped portion, the first relative rotation is a smallest of the plurality of relative rotations.

2. The valve timing control device according to claim 1, wherein, of the plurality of relative rotations from the first relative rotation to the last relative rotation, the plurality of relative rotations from the first relative rotation to a second predetermined relative rotation are configured so as to increase sequentially.

3. The valve timing control device according to claim 2, wherein, of the plurality of relative rotations from the first relative rotation to the last relative rotation, a second plurality of relative rotations are configured so as to be mutually equal.

4. The valve timing control device according to claim 3, wherein the last relative rotation is configured so as to be a second smallest of the plurality of relative rotations.

5. The valve timing control device according to claim 4, wherein the last relative rotation is configured so as to be a largest of the plurality of relative rotations.

6. The valve timing control device according to claim 3, wherein the last relative rotation is configured so as to be a largest of the plurality of relative rotations.

7. The valve timing control device according to claim 2, wherein the last relative rotation is configured so as to be a second smallest of the plurality of relative rotations.

8. The valve timing control device according to claim 7, wherein the last relative rotation is configured so as to be a largest of the plurality of relative rotations.

9. The valve timing control device according to claim 1, wherein, of the plurality of relative rotations from the first relative rotation to the last relative rotation, a second plurality of relative rotations are configured so as to be mutually equal.

10. The valve timing control device according to claim 9, wherein the last relative rotation is configured so as to be a second smallest of the plurality of relative rotations.

11. The valve timing control device according to claim 10, wherein the last relative rotation is configured so as to be a largest of the plurality of relative rotations.

12. The valve timing control device according to claim 9, wherein the last relative rotation is configured so as to be a largest of the plurality of relative rotations.

13. The valve timing control device according to claim 1, wherein the last relative rotation is configured so as to be a second smallest of the plurality of relative rotations.

14. The valve timing control device according to claim 13, wherein a range from the $n^{th}-1$ relative rotation phase to the lock phase corresponding to the last relative rotation is set to a relative rotation phase range which allows the engine to be started.

15. The valve timing control device according to claim 13, wherein the last relative rotation is configured so as to be a largest of the plurality of relative rotations.

16. The valve timing control device according to claim 1, wherein the last relative rotation is configured so as to be a largest of the plurality of relative rotations.

17. The valve timing control device according to claim 16, wherein the $n^{th}-1$ relative rotation phase is set to a relative rotation phase which allows the engine to be started, and the relative rotation phase is configured so as to be moved from the most retarded phase or most advanced phase to the $n^{th}-1$ relative rotation phase by torque fluctuation of the camshaft when starting up the engine, and moved from the $n^{th}-1$ relative rotation phase to the lock phase by hydraulic pressure after the engine is started up.

* * * * *